US012690731B2

(12) United States Patent
Zhou et al.

(10) Patent No.: US 12,690,731 B2
(45) Date of Patent: Jul. 28, 2026

(54) TOILET SEAT WITH DELAY SUCTION RELEASE AND AUTOMATICALLY STAND UPRIGHT

(71) Applicant: ZHONGSHAN MEITU PLASTIC IND. CO., LTD., Zhongshan (CN)

(72) Inventors: Wenhui Zhou, Zhongshan (CN); Haojia Huang, Zhongshan (CN)

(73) Assignee: ZHONGSHAN MEITU PLASTIC IND. CO., LTD., Zhongshan (CN)

( * ) Notice: Subject to any disclaimer, the term of this patent is extended or adjusted under 35 U.S.C. 154(b) by 116 days.

(21) Appl. No.: 18/922,466

(22) Filed: Oct. 22, 2024

(65) Prior Publication Data

US 2026/0090684 A1 Apr. 2, 2026

(30) Foreign Application Priority Data

Sep. 28, 2024 (CN) ..... 202411363984.X

(51) Int. Cl.
*A47K 13/12* (2006.01)
*A47K 13/10* (2006.01)
*A47K 13/26* (2006.01)

(52) U.S. Cl.
CPC ..... *A47K 13/12* (2013.01); *A47K 13/105* (2013.01); *A47K 13/26* (2013.01)

(58) Field of Classification Search
CPC ..... A47K 13/12; A47K 13/105; A47K 13/26
See application file for complete search history.

(56) References Cited

U.S. PATENT DOCUMENTS 4,951,325 A * 8/1990 Tack ..... A47K 13/10 16/84
5,604,936 A * 2/1997 Mausolf ..... A47K 13/10 4/246.1
12,193,616 B2 * 1/2025 Pounanov ..... A47K 13/10

FOREIGN PATENT DOCUMENTS

CN 108451428 A * 8/2018 ..... A47K 13/24

* cited by examiner

*Primary Examiner* — Christine J Skubinna
(74) *Attorney, Agent, or Firm* — Bayramoglu Law Offices LLC

(57) ABSTRACT

A toilet seat with delay suction release and automatically stand upright includes a rotary toilet seat rotatably connected to a toilet base. A rotating shaft sleeve provided with a hydraulic hinge inside is fixed at one end of the rotary toilet seat, and a delay release suction and self standing control device that can cause the rotary toilet seat to automatically stand up relative to a toilet is provided on the rotary toilet seat. The delay release suction and self standing control device includes a sucker assembly and a hinge driving component that are set on the rotary toilet seat to delay the release of suction. When the rotational elastic force of the driving torsion spring of the hinge driving component is greater than the suction force of the suction part, the driving torsion spring will drive the rotary toilet seat to automatically open upwards.

10 Claims, 23 Drawing Sheets

TOILET SEAT WITH DELAY SUCTION RELEASE AND AUTOMATICALLY STAND UPRIGHT

CROSS REFERENCE TO THE RELATED APPLICATIONS

This application is based upon and claims priority to Chinese Patent Application No. 202411363984.X, filed on Sep. 28, 2024, the entire contents of which are incorporated herein by reference.

TECHNICAL FIELD

The present disclosure relates to the technical field of flush toilets, in particular to a toilet seat with delay suction release and automatically stand upright.

BACKGROUND

At present, the existing toilet seats are very limited in terms of convenience and hygiene performance. Because after using the toilet, the toilet seat is always horizontally placed on the toilet due to non-human factors. Once the user forgets or is not used to lifting the seat, it may be frequently contaminated by urine, sewage, etc. However, once the toilet seat is quickly lifted, it is easy to collide with the seat cover or water tank to produce noise, which brings a lot of troubles to people's actual use.

The rotary toilet seat in commercial public toilets on the market is manually opened upright to avoid contamination of the rotary toilet seat during urination. Furthermore, the rotary toilet seats in commercial public toilets on the market are all designed without a slow rise function. When the rotary toilet seats collide with ceramics, the noise is loud, which affects the user experience.

In view of the products currently available on the market, the inventor has developed a toilet seat with the function of delayed automatic upright and slow rise.

Therefore, the present disclosure is proposed to address the above-mentioned issues.

SUMMARY

The objective of the present disclosure is to overcome the deficiency of the prior art and provide a toilet seat that can delay the release of suction and automatically stand upright.

The present disclosure is implemented through the following technical solution:

A toilet seat with delay suction release and automatically stand upright, including a rotary toilet seat rotatably connected to a toilet base, and a rotating shaft sleeve provided with a hydraulic hinge inside fixed at one end of the rotary toilet seat, wherein a delay suction release and automatically stand upright control device allowing the rotary toilet seat to automatically stand up relative to the toilet base is provided on the rotary toilet seat; the delay suction release and automatically stand upright control device includes a sucker assembly for delay suction release set on the rotary toilet seat and a hinge driving assembly that drives the rotary toilet seat to rotate and raise up;

the sucker assembly includes a hard mounting frame fixed at a bottom of one side of the rotary toilet seat and a sucker body detachably fixed on the hard mounting frame, wherein the sucker body cooperates with a contact surface of the toilet base to form a sealed space;

the sucker body includes a sucker connection part connected to an inner wall of the hard mounting frame and a suction part connected to a lower end of the sucker connection part; a deformable top plate is provided at a top of the sucker connection part, and an elastic ventilation cut is provided on the deformable top plate to communicate an interior of the sucker body with the air guide channel;

the hinge driving assembly includes fixed rotary arms fixed on both sides of the toilet base, a transverse support shaft provided on the fixed rotary arms, and a driving torsion spring provided on the transverse support shaft, wherein the transverse support shaft is fixedly connected to a rotating shaft core of the hydraulic hinge, one end of the driving torsion spring is a fixed end fixed to the fixed rotary arm, and the other end of the driving torsion spring is a driving end fixed to an inner wall of the rotating shaft sleeve;

when the rotary toilet seat is not under pressure, an external atmosphere slowly enters the suction part through the air guide channel of the sucker assembly from the elastic ventilation cut, causing a suction force between the suction part and the toilet base to gradually decrease, until a rotational elastic force of the driving torsion spring of the hinge driving assembly is greater than the suction force of the suction part, the driving torsion spring drives the rotary toilet seat to automatically open upwards relative to the toilet base.

The further preferred embodiment of the present disclosure is: an external mounting ring and a central fixing sleeve are provided on the hard mounting frame, and the external mounting ring and the central fixing sleeve are formed in integration; the air guide channel is provided between the external mounting ring and the central fixing sleeve; the sucker body is installed inside the central fixing sleeve, and the sucker connection part of the sucker body is clamped with an inner wall of the central fixing sleeve in a snap-fit.

The further preferred embodiment of the present disclosure is: the sucker assembly further includes a deformable tube for supporting the sucker connection part, and the deformable top plate is set at a top of the deformable tube; an annular clamping groove is provided on an outer wall of the deformable tube, and a clamping protrusion that is connected with the annular clamping groove in a snap-fit is provided on an inner wall of the sucker connection part.

The further preferred embodiment of the present disclosure is: a quick installation structure is provided between the sucker body and the central fixing sleeve for quickly installing the sucker body on the hard mounting frame, and the quick installation structure includes a quick installation convex ring provided on an outer wall of the sucker connection part and a quick installation hook provided on the central fixing sleeve and engaged with the quick installation convex ring in a snap-fit.

The further preferred embodiment of the present disclosure is: the quick installation hook or the central fixing sleeve is provided with a strip-shaped through-hole/groove that facilitates the corresponding deformation of the quick installation hook.

The further preferred embodiment of the present disclosure is: one side located on the sucker body of the hard mounting frame is provided with a protective pad, and the protective pad is capable of being abutting with a contact surface when the sucker body is in contact with the contact surface.

The further preferred embodiment of the present disclosure is: a plurality of spaced-apart connecting ribs are connected between the external mounting ring and the central fixing sleeve, and a plurality of the air guide channels arranged at intervals that are connected to the outside atmosphere are formed between the plurality of spaced-apart connecting ribs.

The further preferred embodiment of the present disclosure is: a sucker installation groove for installing the sucker assembly is provided at a bottom of the rotary toilet seat, an outer wall of the external mounting ring is clamped with an inner wall of the sucker installation groove, a top of the external mounting ring is clamped at a bottom of the sucker installation groove, a height of the top of the external mounting ring is higher than a height of a top of the central fixed sleeve, and there is a ventilation gap between the top of the central fixed sleeve and the bottom of the sucker installation groove; when the elastic ventilation cut is opened, it communicates with the air guide channel through the ventilation gap.

The further preferred embodiment of the present disclosure is: a transverse slot is provided on the fixed rotary arm, a fixed end of the driving torsion spring is inserted into the transverse slot to position the driving torsion spring on the fixed rotary arm, a driving slot is provided on the inner wall of the rotating shaft sleeve, and a driving end of the driving torsion spring is inserted into the driving slot to drive the rotating shaft sleeve to rotate relative to the fixed rotary arm under its own elastic force.

The further preferred embodiment of the present disclosure is: a fixed clamp block is provided on an outer wall of one end of the hydraulic hinge, a positioning clamp slot for clamping the fixed clamp block is provided in the rotating shaft sleeve, a clamp hole is provided on an outer wall of the rotating shaft sleeve, an annular sliding groove is provided on the transverse support shaft opposite to the clamp hole, a clamping piece is installed in the clamp hole, and the clamping piece is capable of passing through the rotating shaft sleeve to snap onto one side wall of the annular sliding groove and slide along the annular sliding groove.

Compared with the prior arts, the present disclosure has the following advantages:

1. When the rotary toilet seat is not under pressure, the external atmosphere will slowly enter the suction part through the air guide channel of the sucker assembly from the elastic ventilation cut, causing the suction force between the suction part and the toilet base to gradually decrease. When the rotational elastic force of the driving torsion spring of the hinge driving assembly is greater than the suction force of the suction part, the driving torsion spring will drive the rotary toilet seat to automatically open upwards, achieving a slow upward opening until it is in an upright state. The product achieves a silent, clean and hygienic effect during use.
2. The sucker assembly automatically releases its suction state at the target time, and the hinge driving assembly installed on the toilet base serves as the automatic flipping mechanism. When the user presses rotary toilet seat, it can be attached to the toilet base through the sucker assembly. When the user finishes using the toilet, the sucker assembly will automatically delay the release of the suction state, then rotary toilet seat to automatically flip up and reset, achieving fully automatic driving.
3. When the rotary toilet seat is under pressure, the sucker body moves towards the contact surface side. As the volume of the inner cavity of the sucker body gradually decreases, a pressure difference is generated between the inner cavity of the sucker body and the pressure outside. The existence of the pressure difference causes the deformation part to deform accordingly, so that the elastic ventilation cut becomes a ventilation switch that connects the inner cavity of the sucker body with the outside, and the gas in the inner cavity of the sucker body is blown out from the elastic ventilation cut, making it easier for the sucker body to move towards the contact surface side. When the gas in the inner cavity of the sucker body is discharged completely, the elastic ventilation cut becomes a ventilation port that isolates the inner cavity of the sucker body from the outside under the deformation reset force of the deformation part, so that the contact surfaces between the sucker body and the toilet base is sealed to ensure that the sucker body and the toilet base are firmly and reliably suction efficiency.
4. For the convenience of disassembly and assembly, there is a snap-fit structure between the outer wall of the installation part and the inner wall of the sucker connection part.
5. In order to prevent the sucker from being damaged due to overpressure, the mounting bracket is equipped with a protective pad on one side of the sucker body that can come into contact with the contact surface when the sucker body is matched.

BRIEF DESCRIPTION OF THE DRAWINGS

The specific embodiments of the present disclosure will be further illustrated in conjunction with the accompanying drawings.

DETAILED DESCRIPTION OF THE EMBODIMENTS

Figure 1:
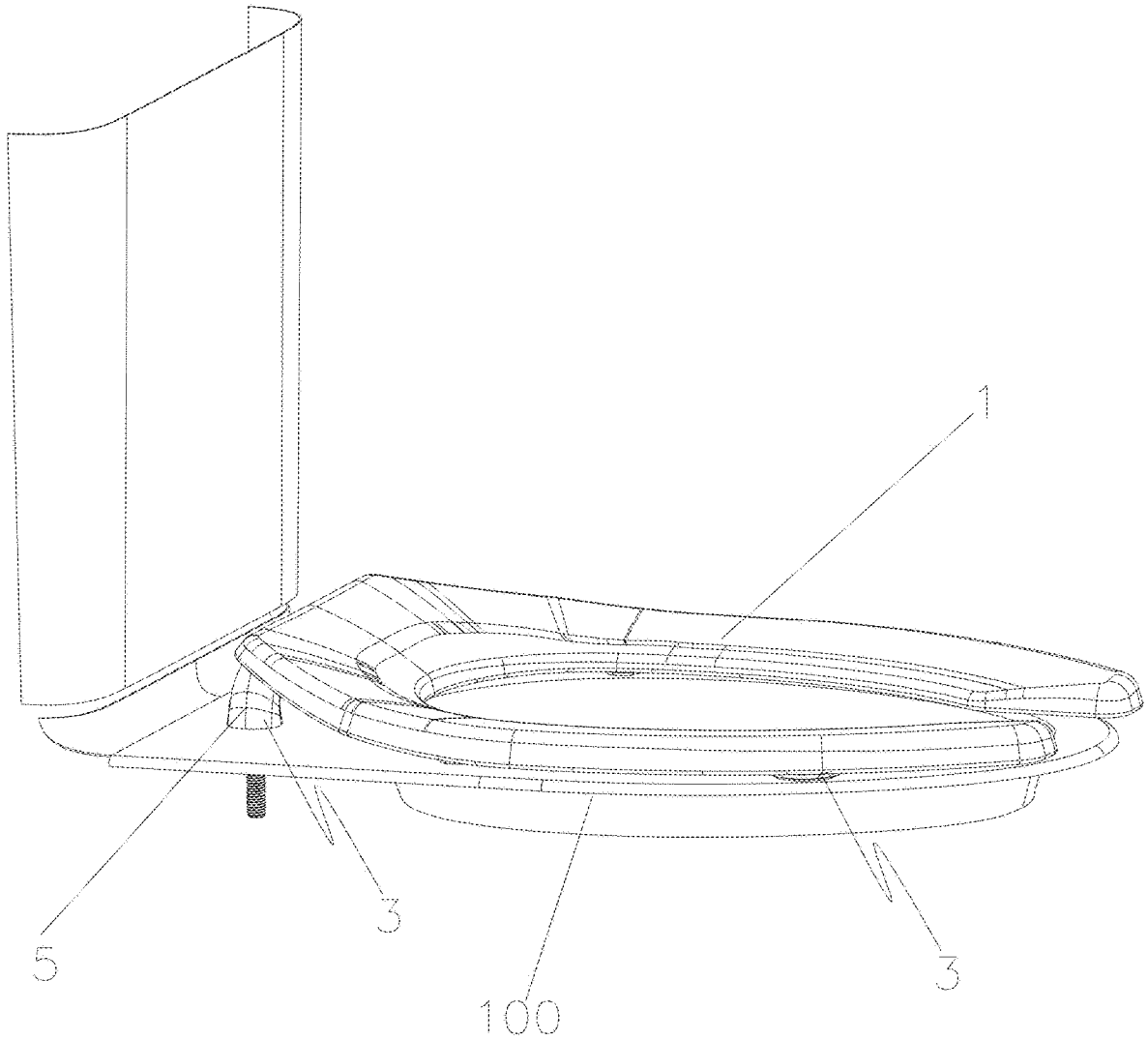
FIG. 1 is a structural diagram of the rotary toilet seat of the present disclosure when it is attached to the toilet base.
Figure 2:
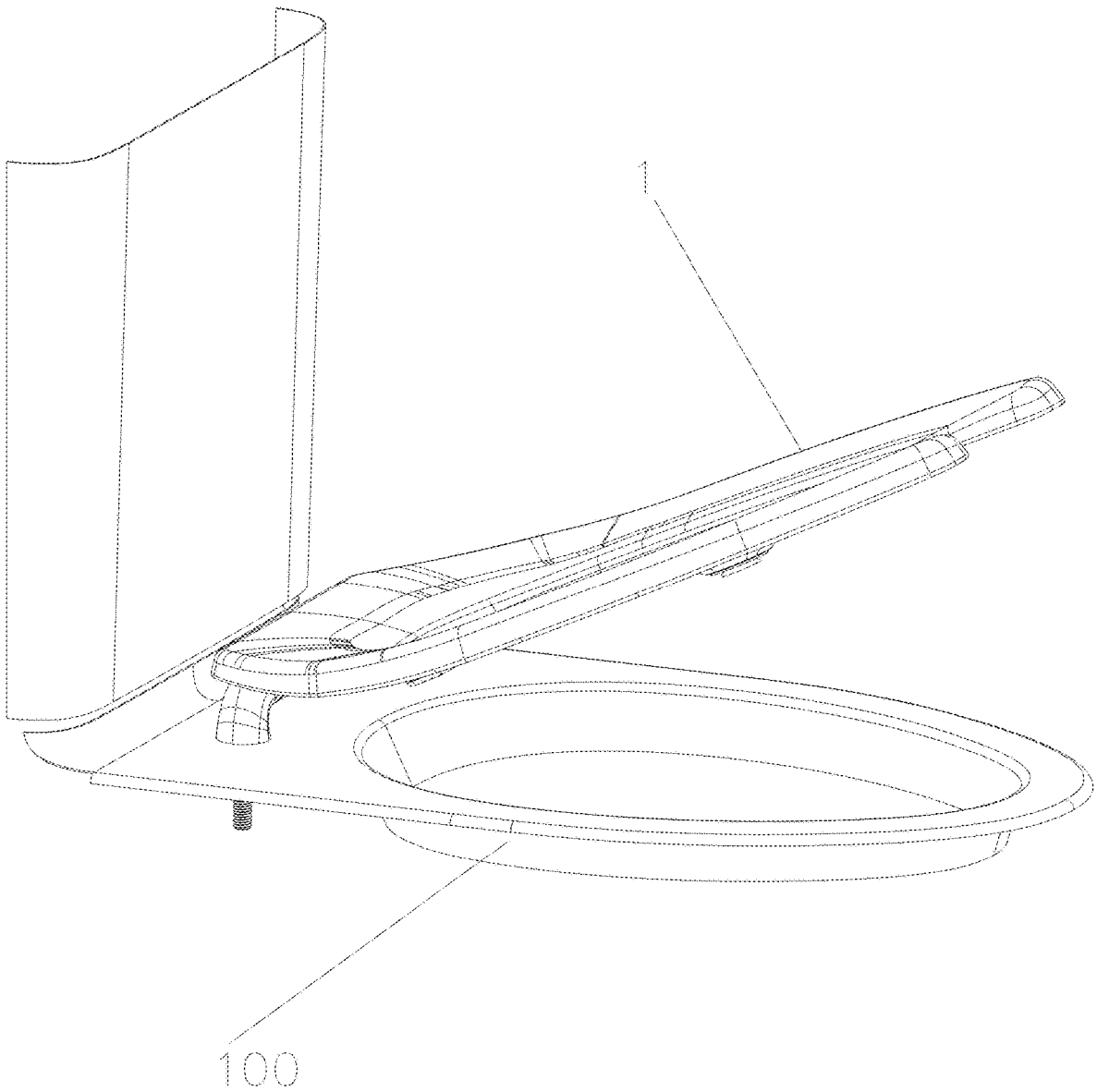
FIG. 2 is a structural diagram of the rotary toilet seat of the present disclosure when it leaves the toilet base and opens at a certain angle.
Figure 3:
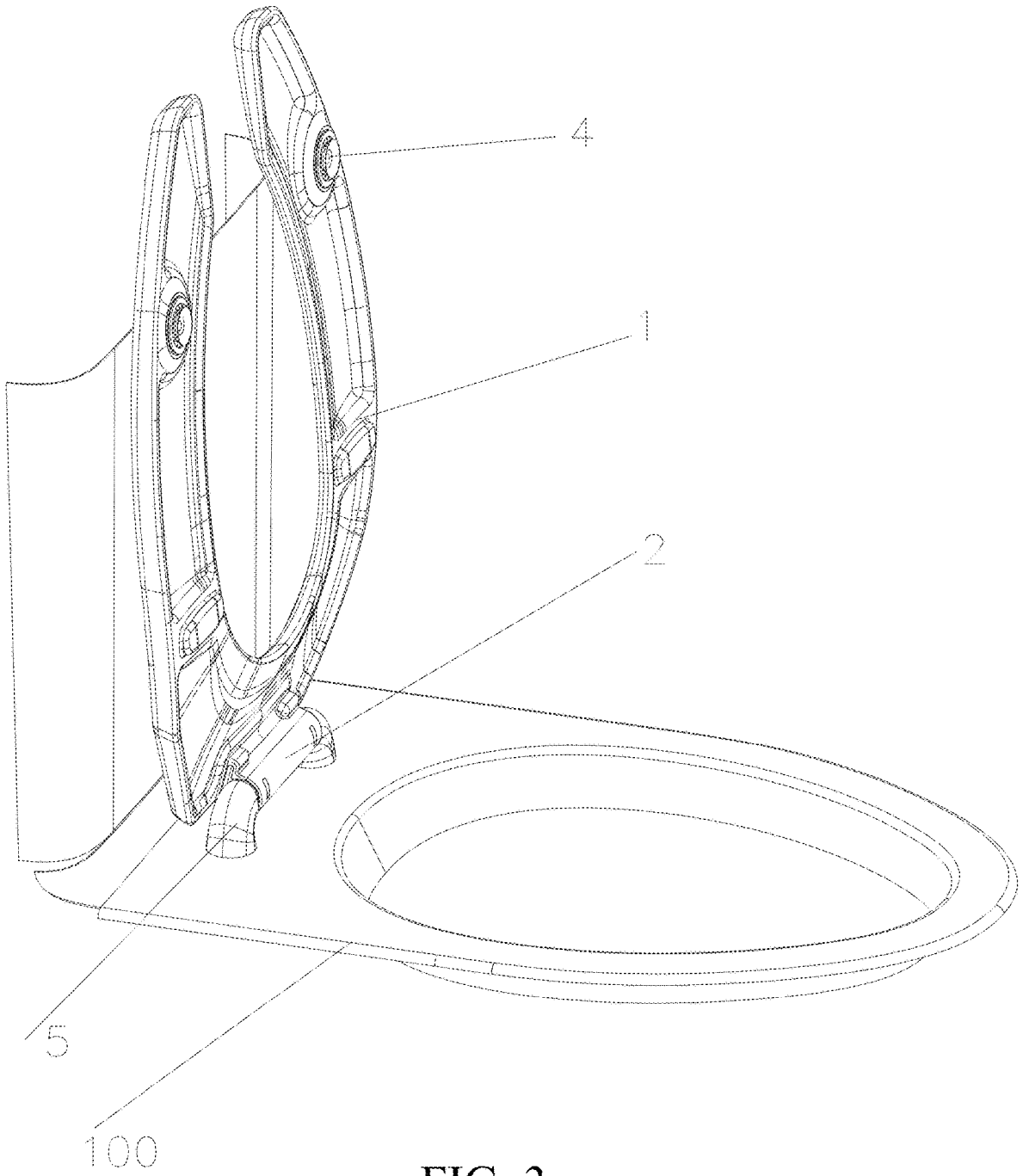
FIG. 3 is a structural diagram of the rotary toilet seat of the present disclosure when it leaves the toilet base and is fully opened and upright.
Figure 4:
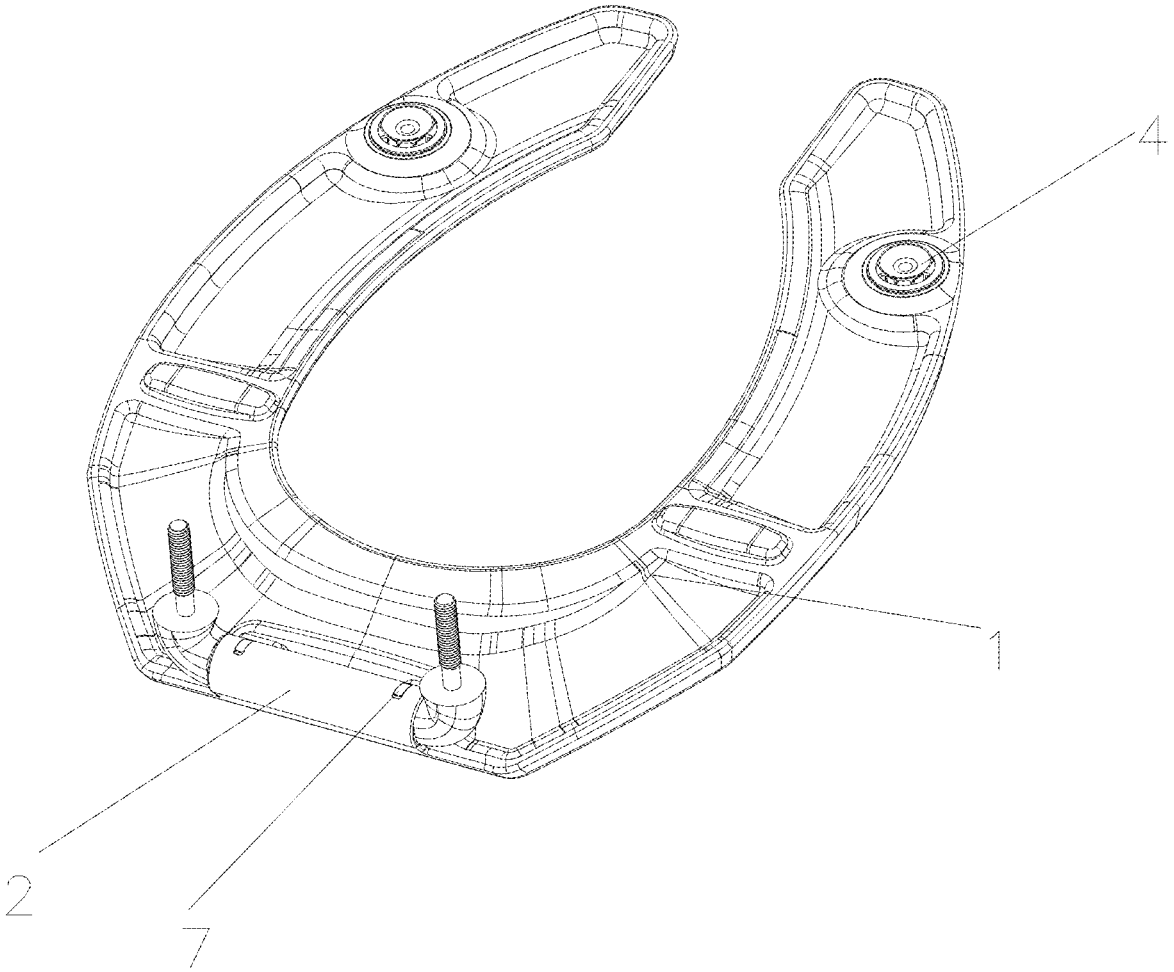
FIG. 4 is a perspective view of the present disclosure.
Figure 5:
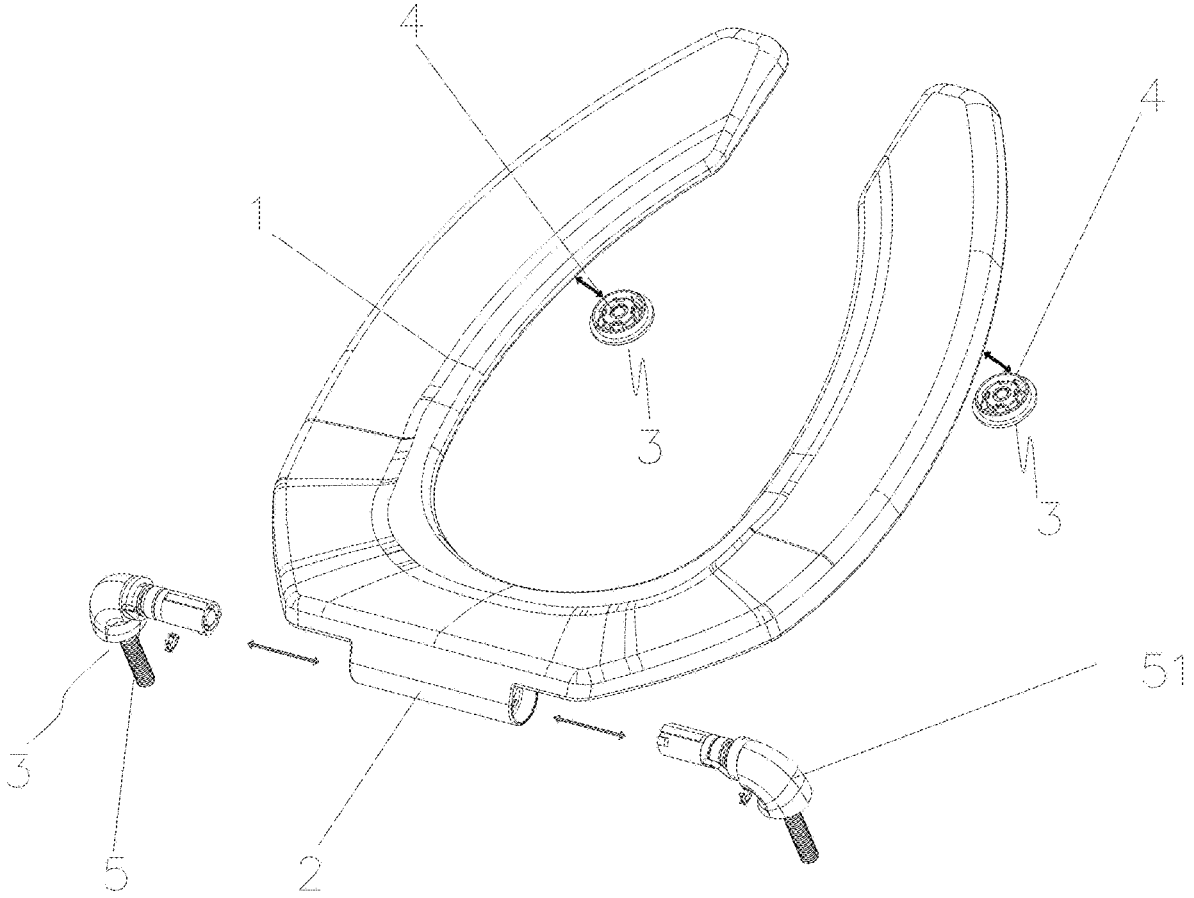
FIG. 5 is the first exploded view of the present disclosure.
Figure 6:
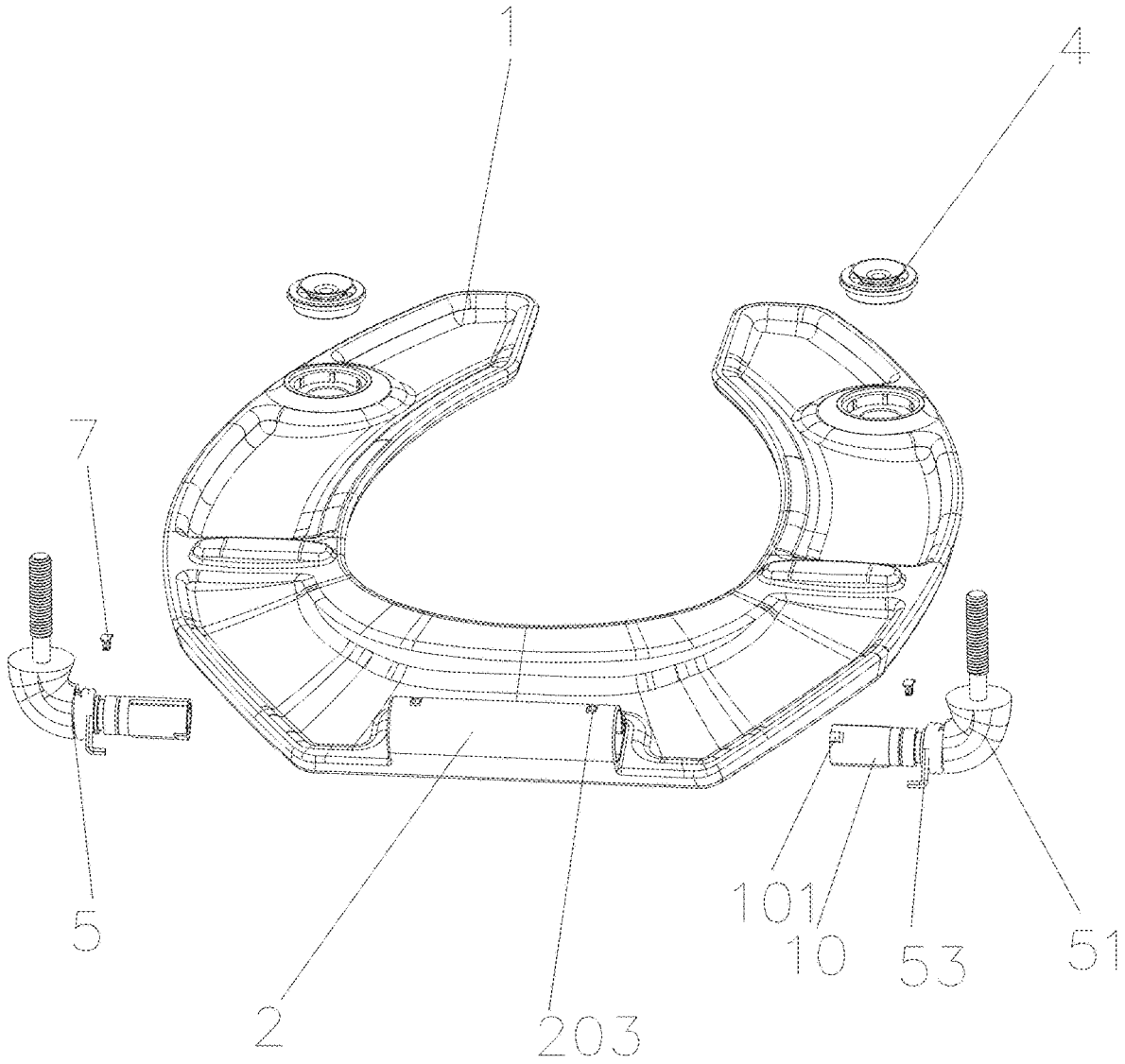
FIG. 6 is the second exploded view of the present disclosure.
Figure 7:
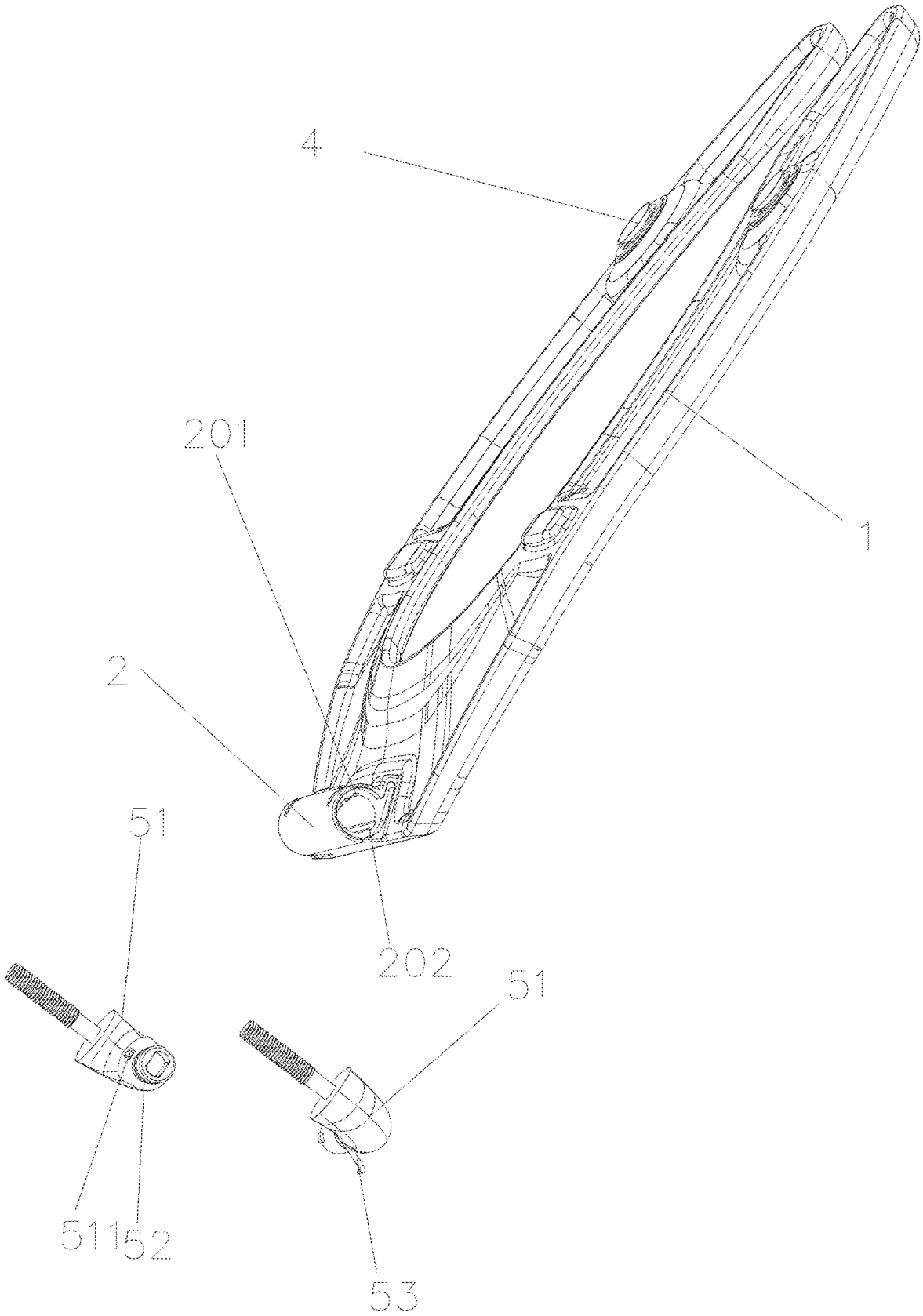
FIG. 7 is the third exploded view of the present disclosure.
Figure 8:
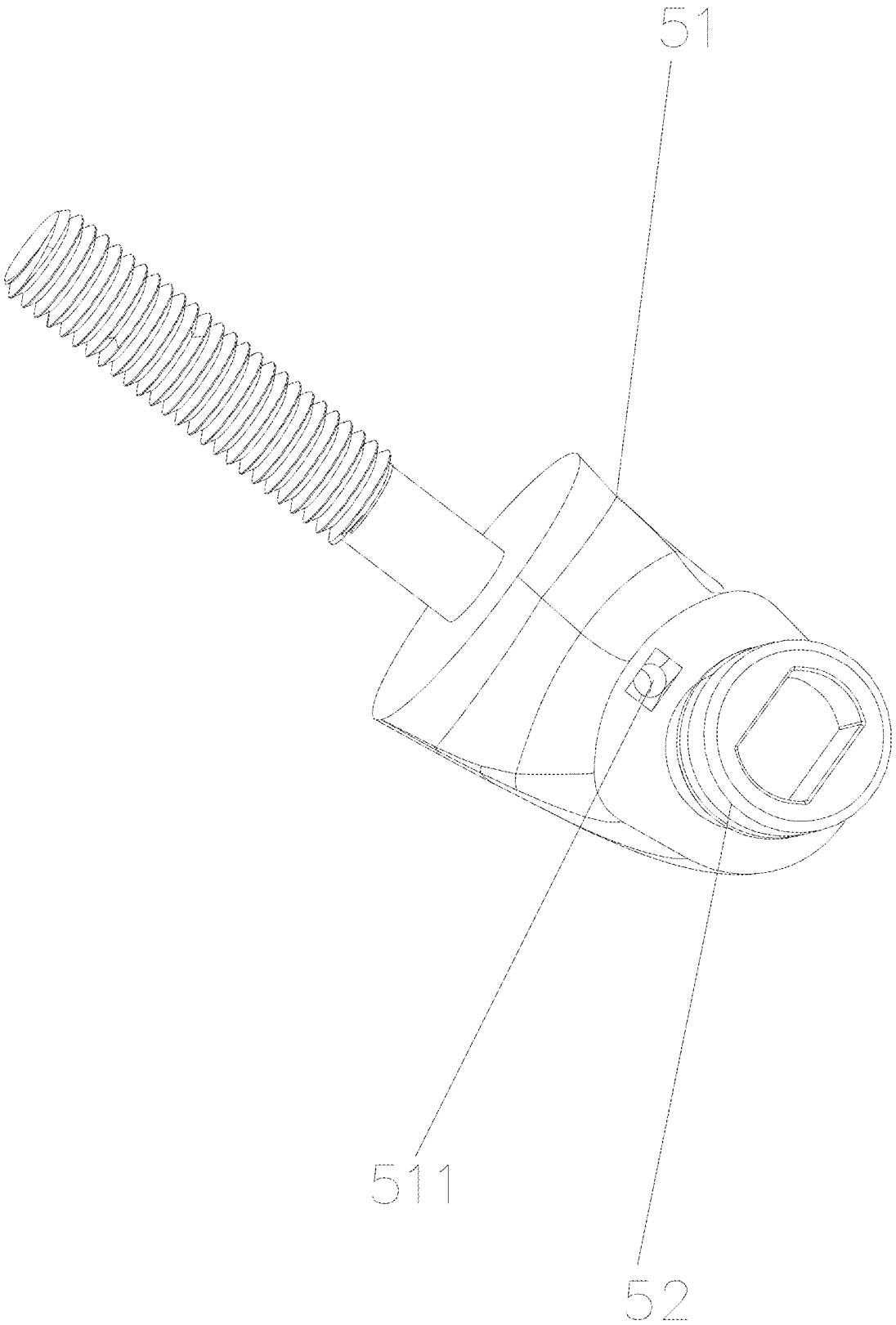
FIG. 8 is a perspective view of the hinge driving assembly of the present disclosure.
Figure 9:
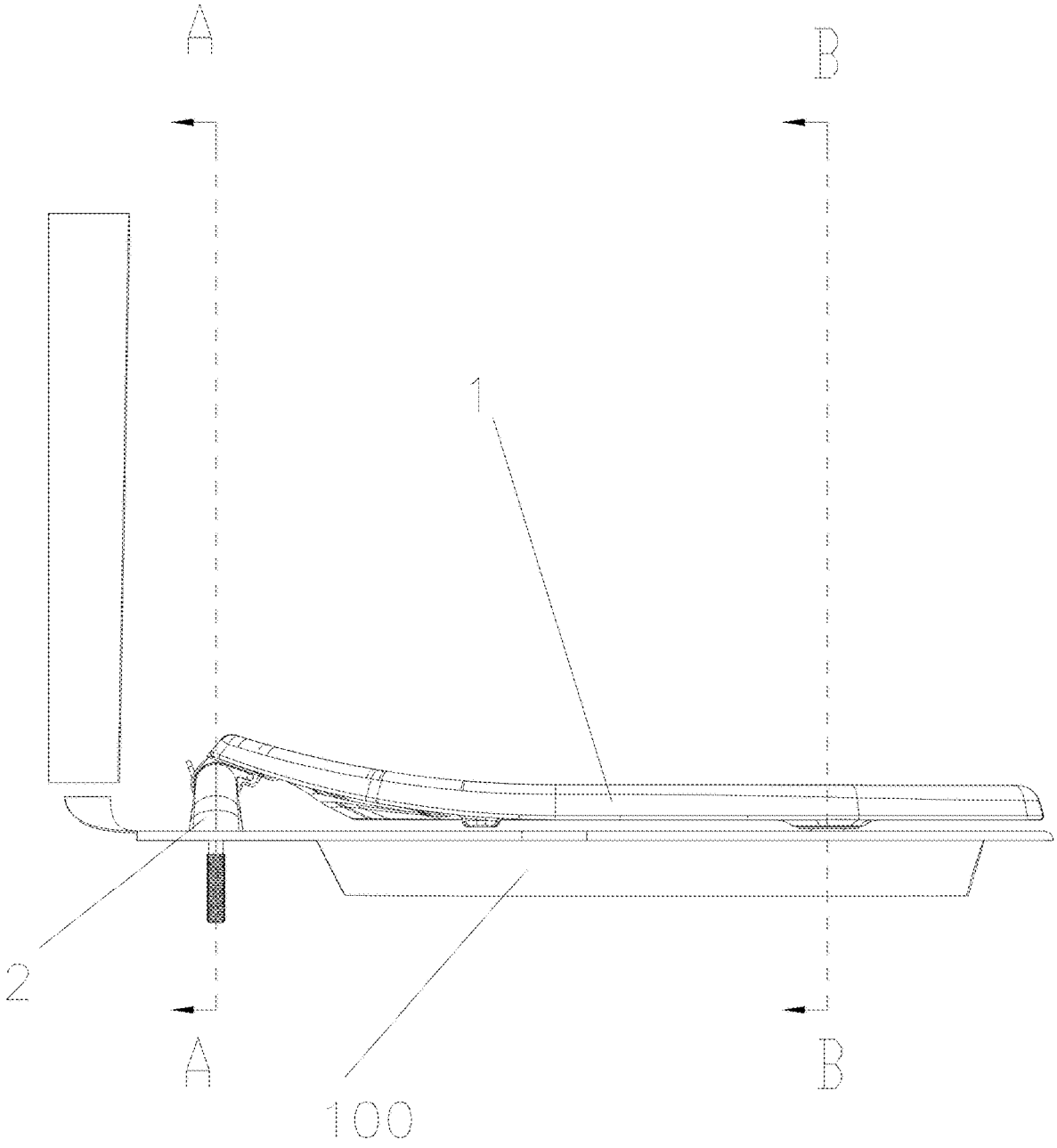
FIG. 9 is a lateral view of the present disclosure.
Figure 10:
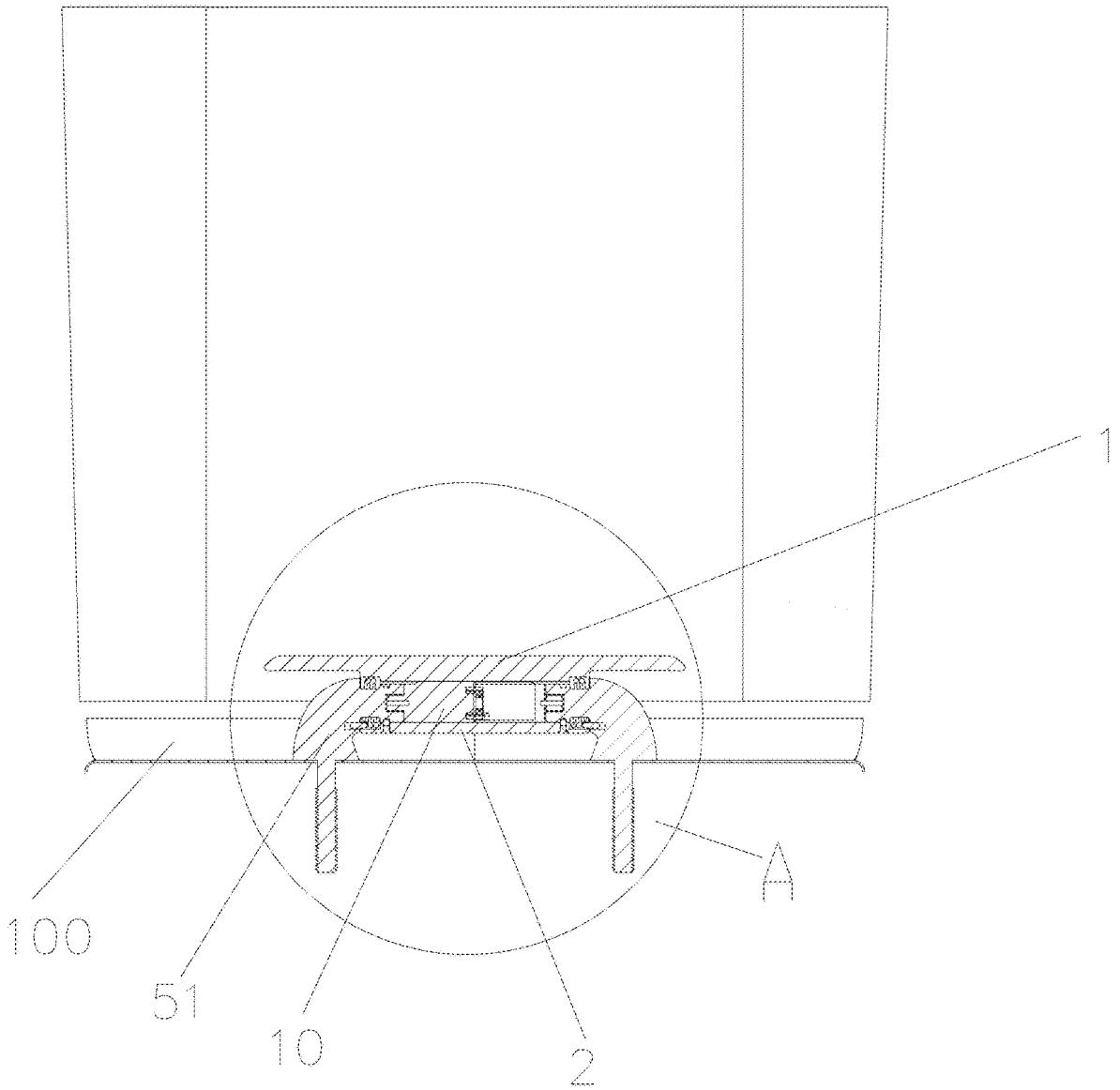
FIG. 10 is a top view of FIG. 9.
Figure 11:
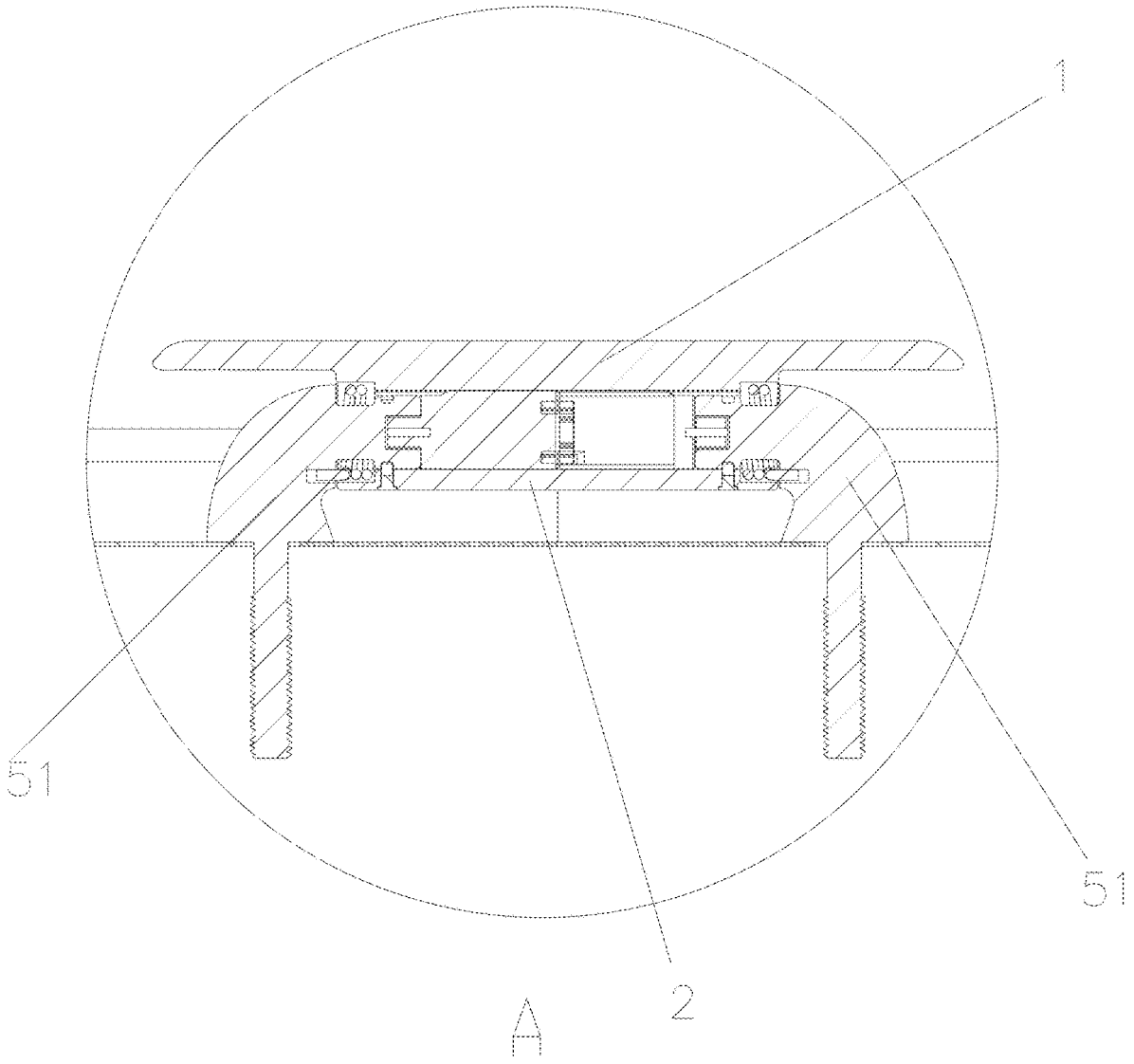
FIG. 11 is an enlarged partial view of part A in FIG. 10.
Figure 12:
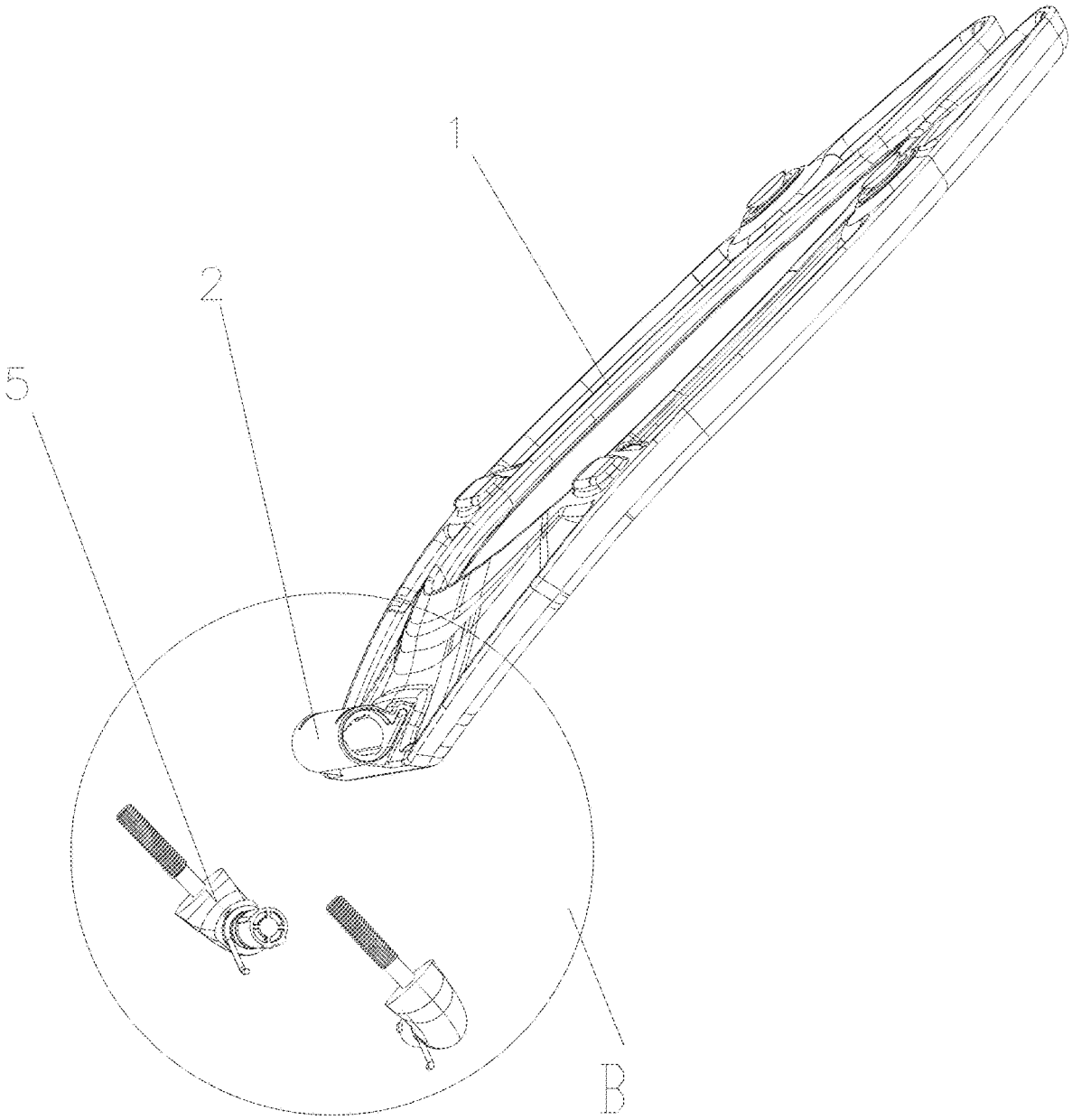
FIG. 12 is the fourth exploded view of the present disclosure.

The embodiments of the present disclosure will be described below in detail with reference to the accompanying drawings.

As shown in FIG. 1-FIG. 27, the present disclosure provides a toilet seat with delay suction release and automatically stand upright, which includes a rotary toilet seat 1 rotatably connected to a toilet base 100, a rotating shaft sleeve 2 provided with a hydraulic hinge 10 inside fixed at one end of the rotary toilet seat 1, and a delay suction release and automatically stand upright control device 3 that can enable the rotary toilet seat 1 to automatically stand up relative to the toilet base with delayed release of suction. The delay suction release and automatically stand upright control 3 includes a sucker assembly 4 set on the rotary toilet seat 1 and a hinge driving assembly 5 that drives the rotary toilet seat 1 to rotate and stand up relative to the toilet base 100; The whole rotary toilet seat is composed of two main parts: the sucker assembly and the hinge driving assembly (as shown in FIG. 1-FIG. 7). The "sucker assembly" consists of multiple parts (as shown in FIG. 20-FIG. 27), which can be disassembled and assembled in the rotary toilet seat. The "sucker assembly" and "hinge driving assembly" are fixed on the rotary toilet seat to assemble into a whole product.

Referring to FIG. 18-FIG. 27, the sucker assembly 4 includes a hard mounting frame 41 fixed at the bottom of one side of the rotary toilet seat 1. A sucker body 42 is detachably fixed on the hard mounting frame 41, and the sucker body 42 cooperates with the contact surface of the toilet base 100 to form a sealed space. The sucker body 42 includes a sucker connection part 421 connected to the inner wall of the hard mounting frame 41 and an suction part 422 connected to the lower end of the sucker connection part 421. A deformable top plate 423 is provided at the top of the sucker connection part 421, and an elastic ventilation cut 420 is provided on the deformable top plate 423 to connect the interior of the sucker body 42 with the air guide channel 410.

Referring to FIG. 5-FIG. 15, the hinge driving assembly 5 includes fixed rotary arms 51 fixed on both sides of the toilet base 100. A transverse support shaft 52 fixedly connected to the rotating shaft core of the hydraulic hinge 10 is provided on the fixed rotary arm 51. A driving torsion spring 53 is provided on the transverse support shaft 52. One end of the driving torsion spring 53 is a fixed end fixed to the fixed rotary arm 51, and the other end of the driving torsion spring 53 is a driving end fixed to the inner wall of the rotating shaft sleeve 2.

When the rotary toilet seat 1 is not under pressure, the external atmosphere will slowly enter the suction part 422 through the air guide channel 410 of the sucker assembly 4 from the elastic ventilation cut 420, causing the suction force between the suction part 422 and the toilet base to gradually decrease. When the rotational elastic force of the driving torsion spring 53 of the hinge driving assembly 5 is greater than the suction force of the suction part, the driving torsion spring 53 will drive the rotary toilet seat 1 to automatically open upwards.

Referring to FIG. 18-FIG. 27, in order to effectively improve the structure of the sucker assembly to enhance the suction capacity and slow release of suction, an innovative design of the sucker assembly is carried out. The specific structure is as follows: an external mounting ring 411 and a central fixing sleeve 412 formed in integration are provided on the hard mounting frame 41, and the air guide channel 410 is provided between the external mounting ring 411 and the central fixing sleeve 412. The sucker body 42 is installed inside the central fixing sleeve 412, and the sucker connection part 421 of the sucker body 42 is connected with the inner wall of the central fixing sleeve 412 in a tight snap-fit.

Referring to FIG. 18-FIG. 26, in order to facilitate the control of the delay time and achieve effective control of the opening and closing effect of the elastic ventilation cut, targeted research and development has been carried out on the position design of the deformation plate of the sucker body. The first implementation solution is as follows: the sucker assembly 4 further includes a deformable tube 43 for supporting the sucker connection part 421, and the deformable top plate 423 is set at the top of the deformable tube 43. An annular clamping groove 431 is provided on the outer wall of the deformable tube 43, and a clamping protrusion 44 that is engaged with the annular clamping groove 431 is provided on the inner wall of the sucker connection part 421.

Figure 27:
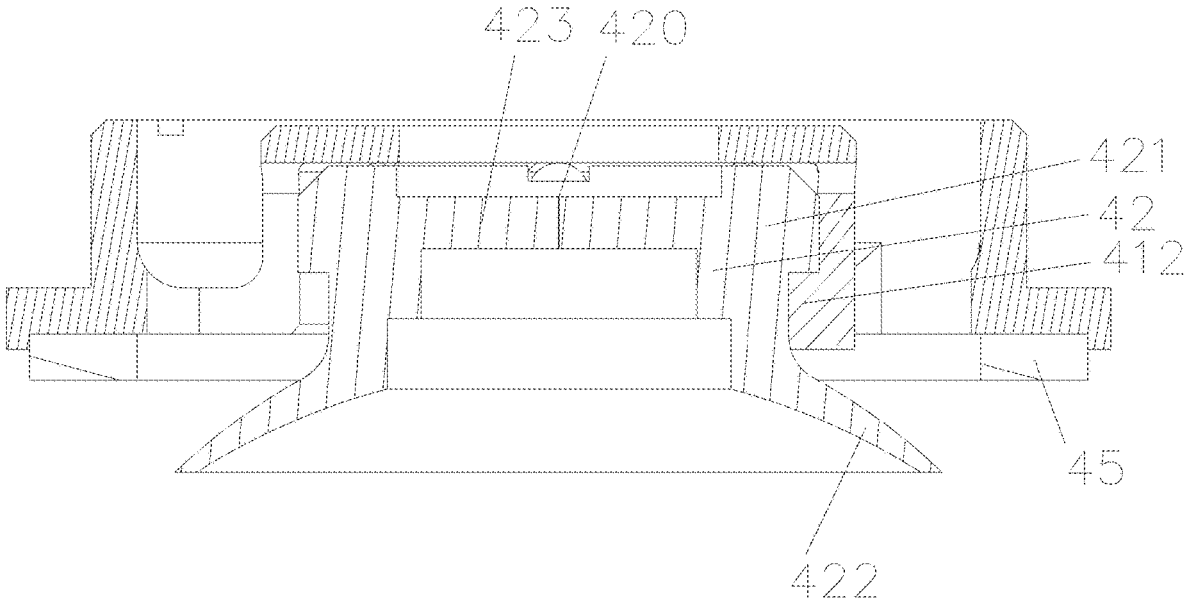
FIG. 27 is a cross-sectional view of an sucker assembly in another embodiment.

The second implementation solution is as shown in FIG. 27. The difference compared to the second implementation solution is that there is no deformation pipe, and the deformable top plate 423 is directly set on the top of the sucker connection part 421 of the sucker body 42, that is to say, the deformable top plate 423 is integrally formed with the sucker connection part 421.

Referring to FIG. 20-FIG. 26, in order to facilitate the quick installation and disassembly of the sucker body 42, a quick installation structure is specially designed. That is, a quick installation structure 6 is provided between the sucker body 42 and the central fixing sleeve 412 for quick installation of the sucker body 42 on the hard mounting frame 41. The quick installation structure 6 includes a quick installation convex ring 61 provided on the outer wall of the sucker connection part 421 and a quick installation hook 62 provided on the central fixing sleeve 412 and connected with the quick installation convex ring 61 in a snap-fit. By aligning the sucker body with the center fixing sleeve 412 and then pushing the sucker body upwards, when the quick installation convex ring 61 on the outer wall of the sucker connection part 421 collides with the quick installation hook 62, the quick installation hook 62 deforms and moves outward, after the sucker connection part 421 is installed in position, the quick installation hook 62 resets and snaps the quick installation convex ring 61, so as to quickly install the sucker body onto the central fixed sleeve. The quick installation hook 62 or the central fixing sleeve 412 is provided with a strip-shaped through-hole/groove 621 that facilitates the corresponding deformation of the quick installation hook 62, so as to facilitate the deformation of the quick installation hook.

Figure 26:
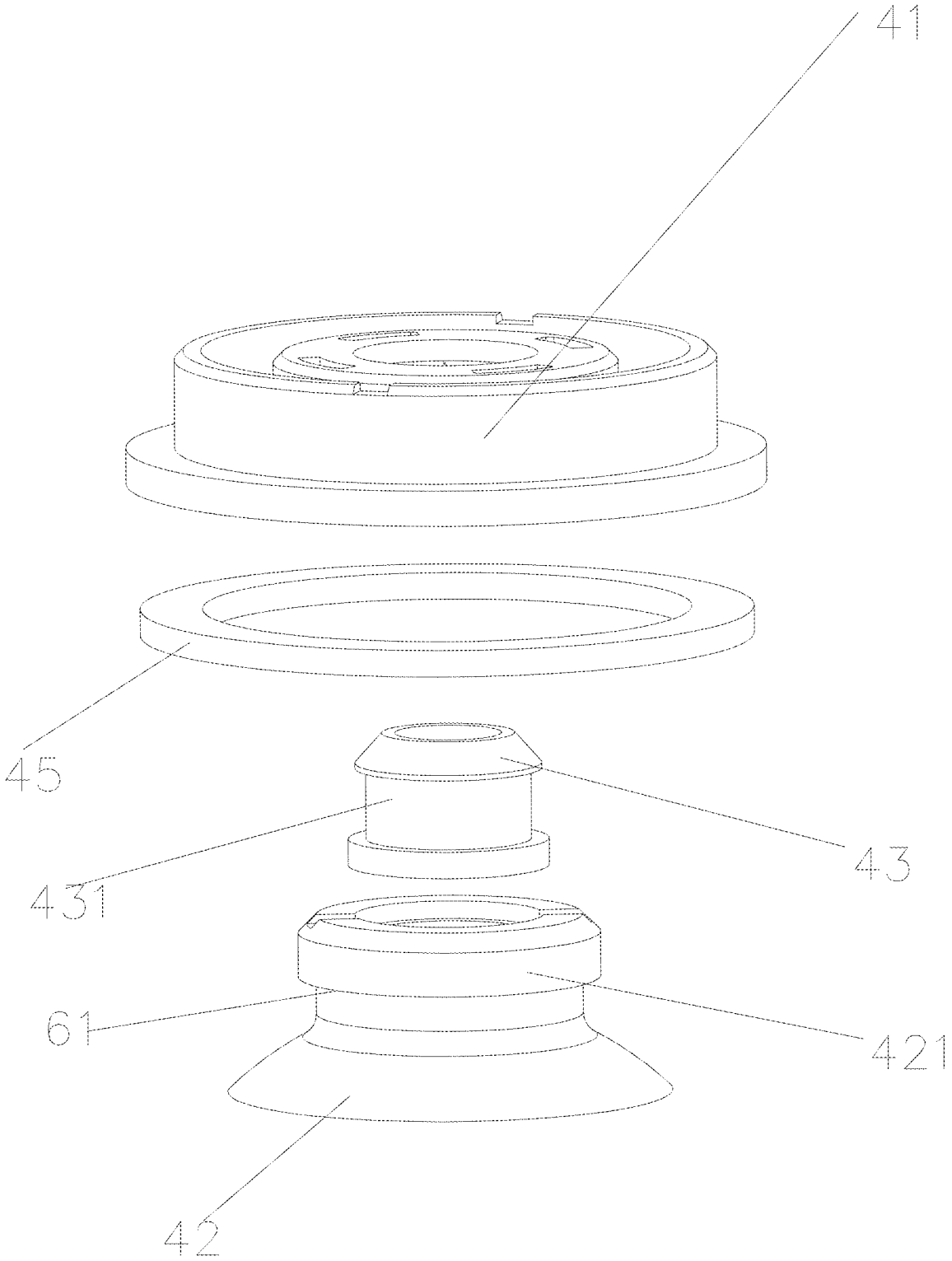
FIG. 26 is an exploded view of the sucker assembly.

Referring to FIG. 26, in order to prevent the sucker from being crushed due to overpressure, the hard mounting frame 41 is located on one side of the sucker body 42 and is equipped with a protective pad 45 that can abut with the contact surface when the sucker body 42 is matched with the contact surface, wherein the protective pad 10 can be made of materials such as plastic, silicone, rubber, etc. In some embodiments, the protective pad 10 can be molded onto the hard mounting frame 41 using an elastic material through secondary injection molding, or can be adhered to the hard mounting frame 41 using a foam type elastic pad adhesive.

Figure 23:
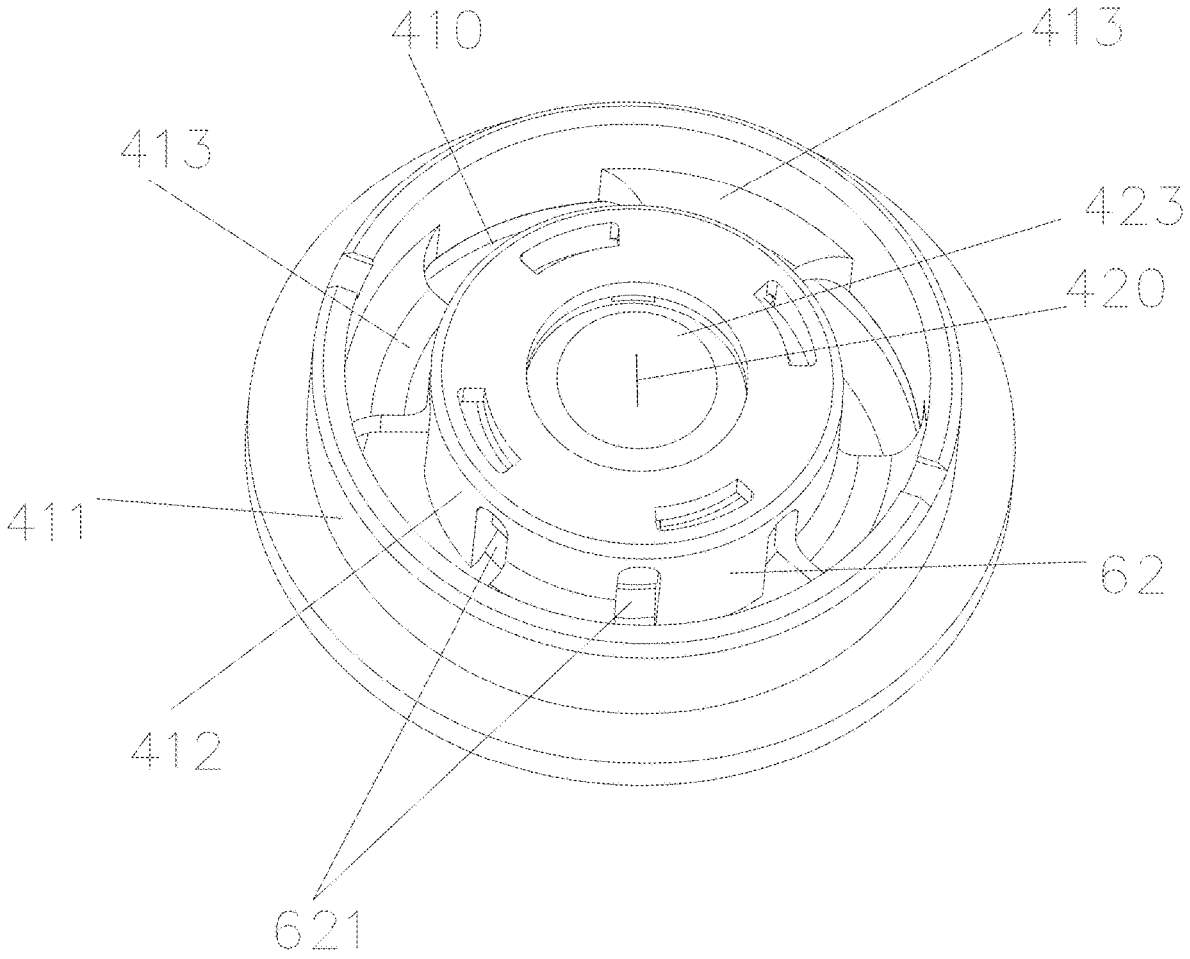
FIG. 23 is the second perspective view of the sucker assembly.
Figure 24:
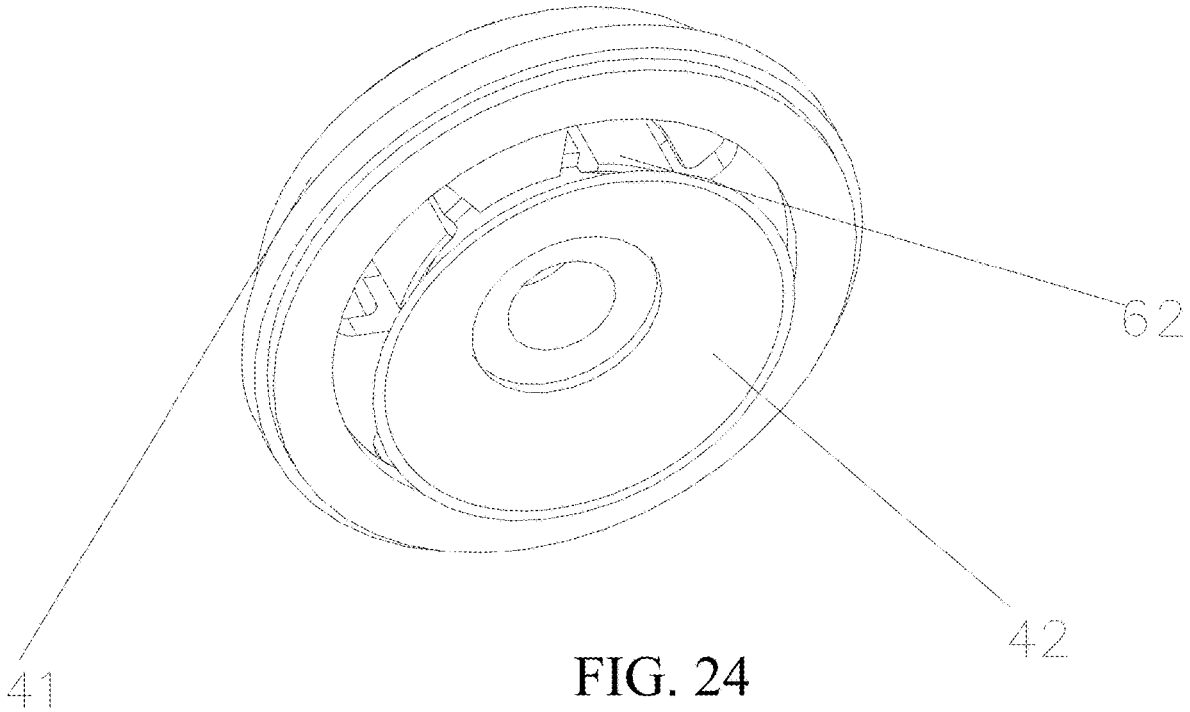
FIG. 24 is the third perspective view of the sucker assembly.
Figure 25:
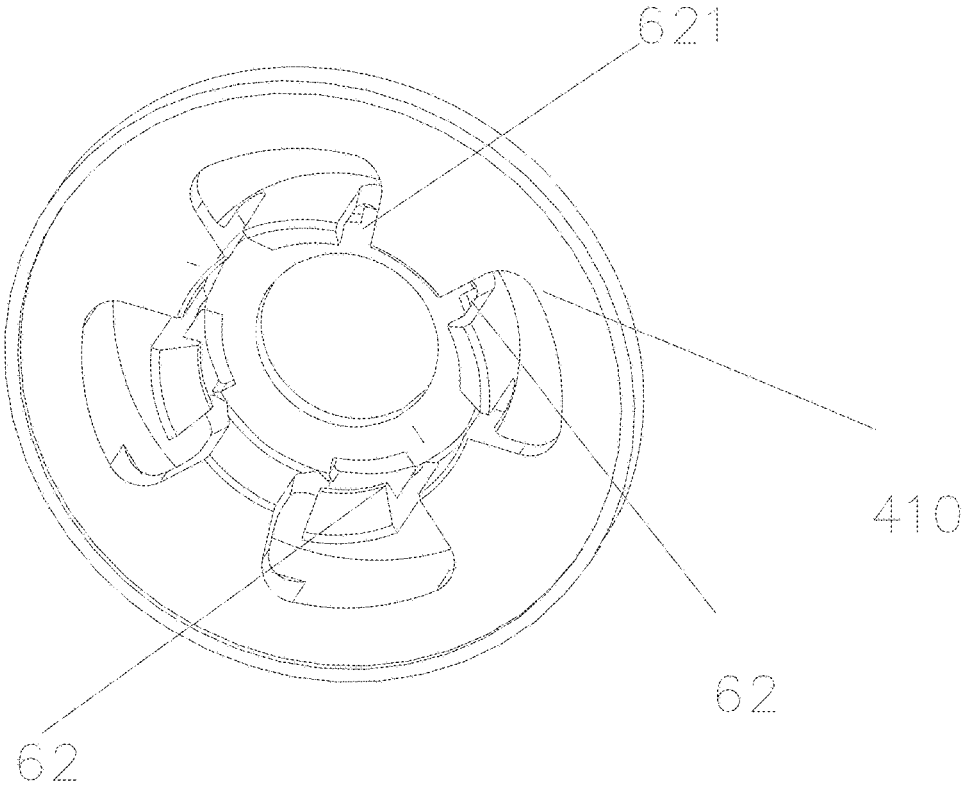
FIG. 25 is the fourth perspective view of the sucker assembly.

Referring to FIG. 23, there are several spaced connecting ribs 413 connected between the external mounting ring 411 and the central fixing sleeve 412, and a plurality of air guide channels 410, which are connected to the outside atmosphere, are formed at intervals between the several spaced connecting ribs 413.

Figure 18:
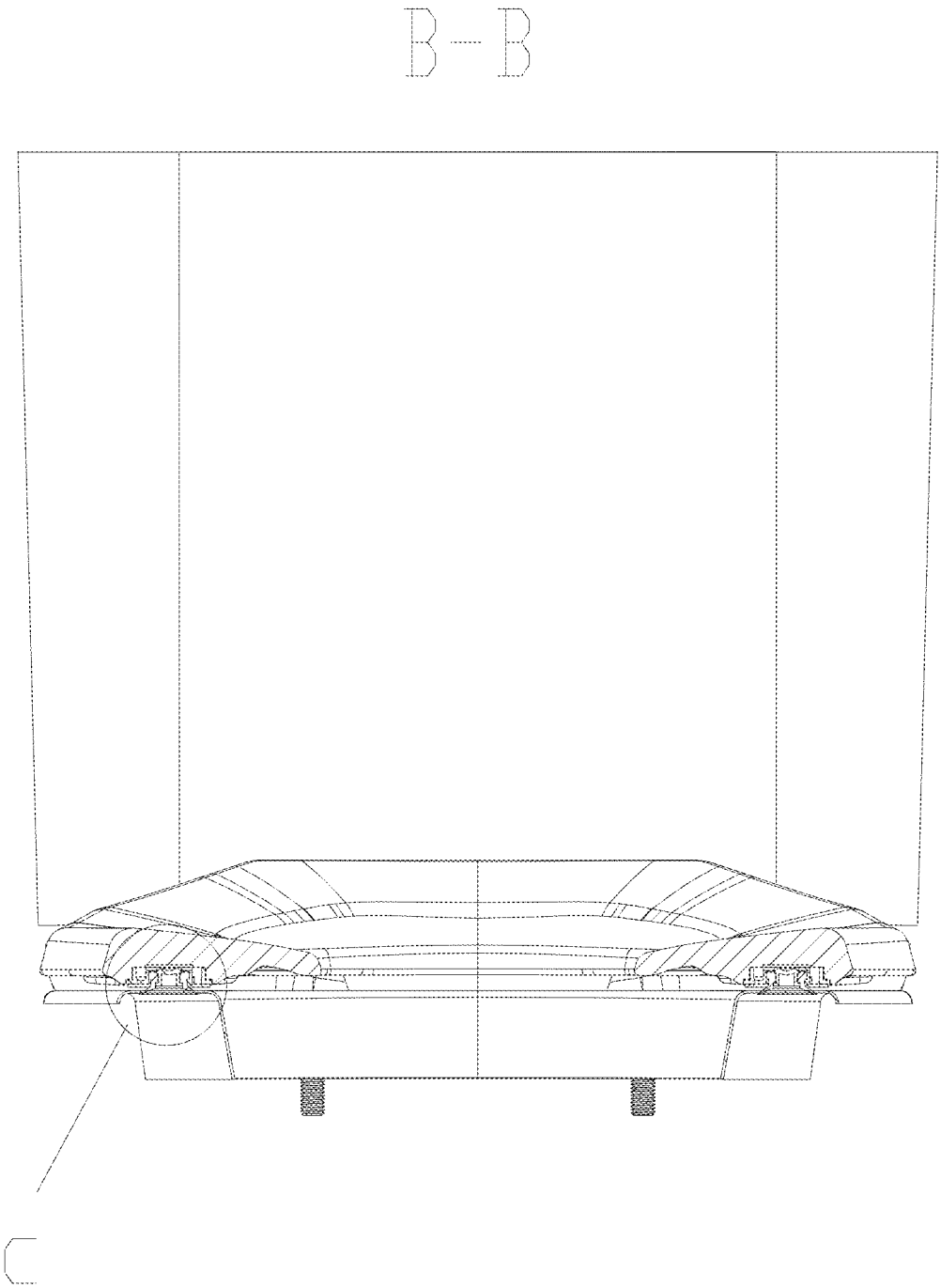
FIG. 18 is a top view of structural diagram of the present disclosure.
Figure 19:
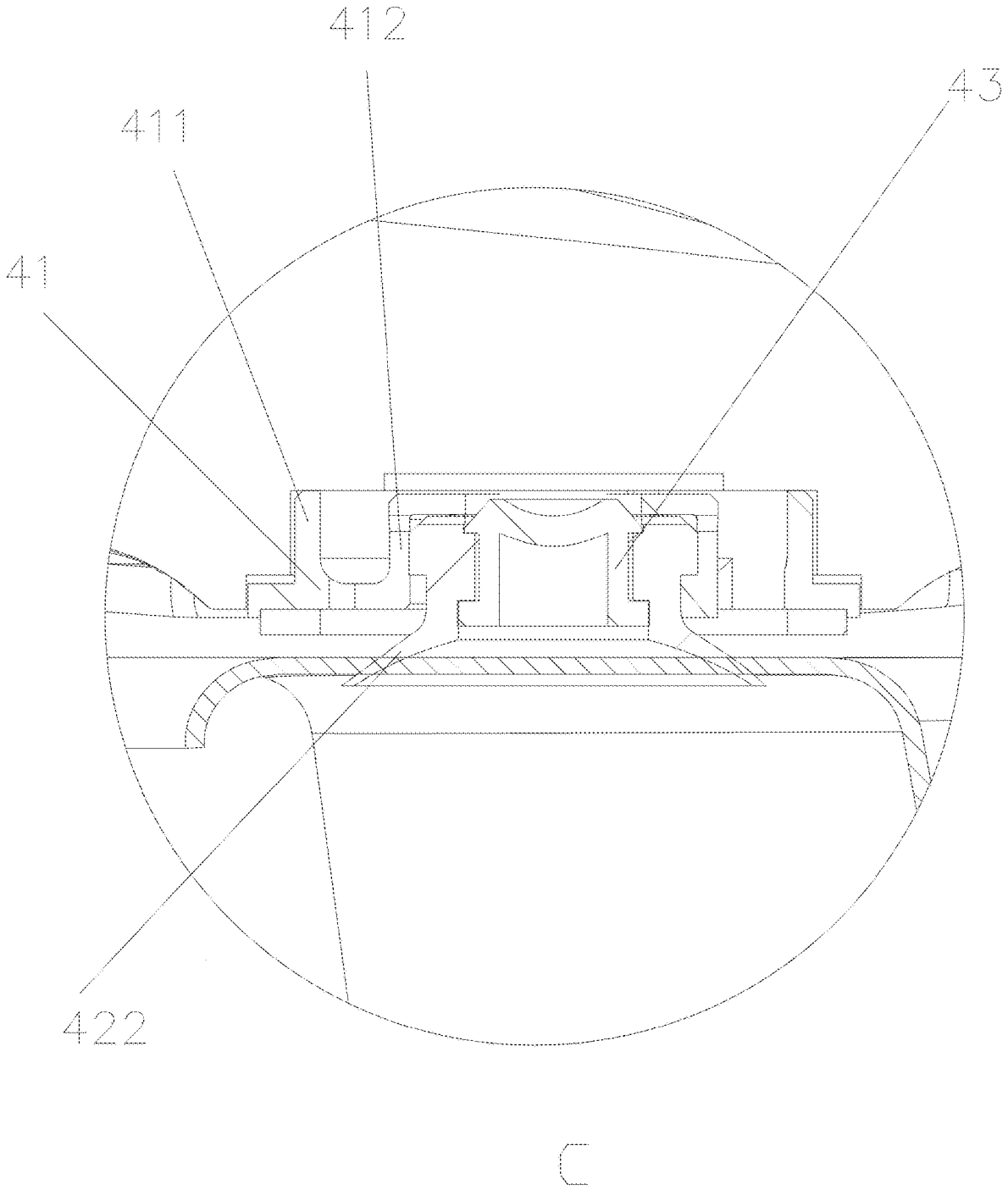
FIG. 19 is an enlarged partial view of part C in FIG. 18.
Figure 20:
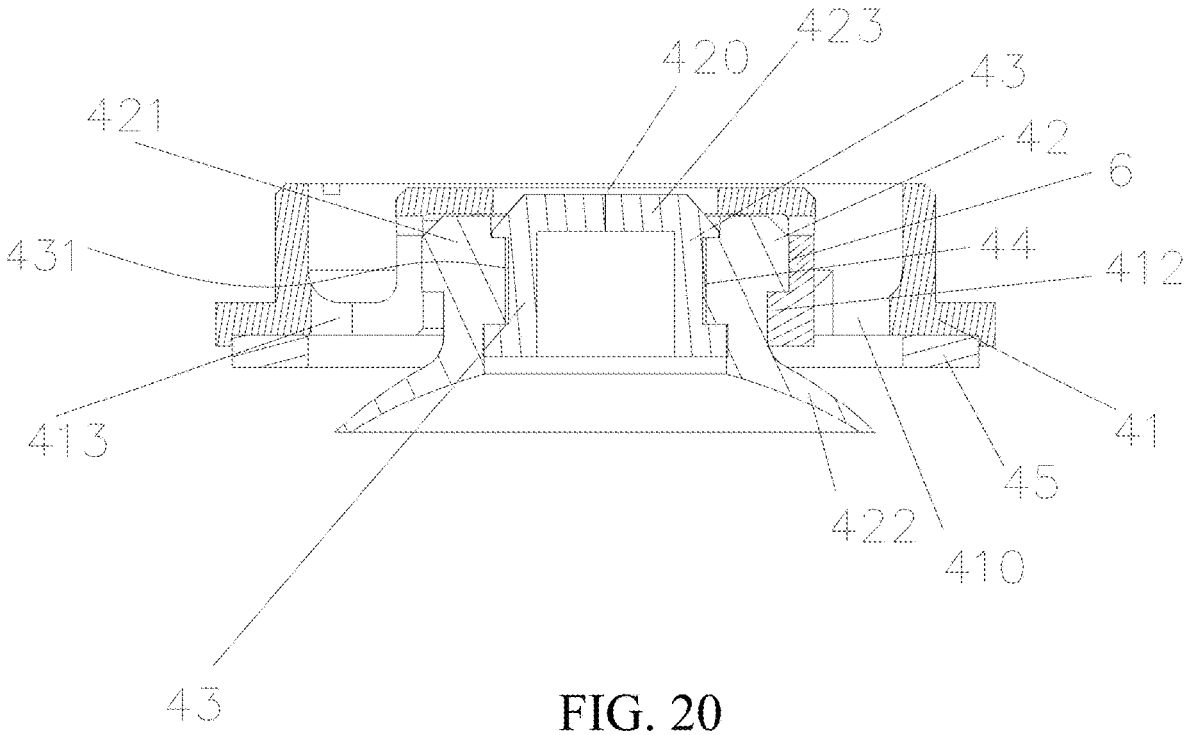
FIG. 20 is the first cross-sectional view of a sucker assembly.
Figure 21:
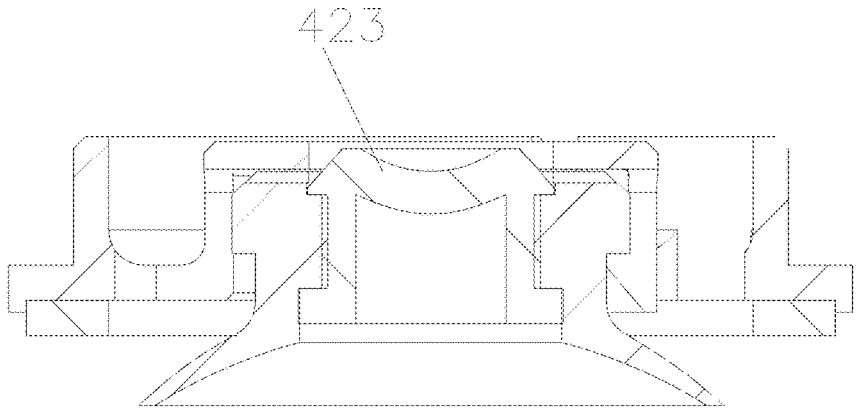
FIG. 21 is the second cross-sectional view of the sucker assembly.
Figure 22:
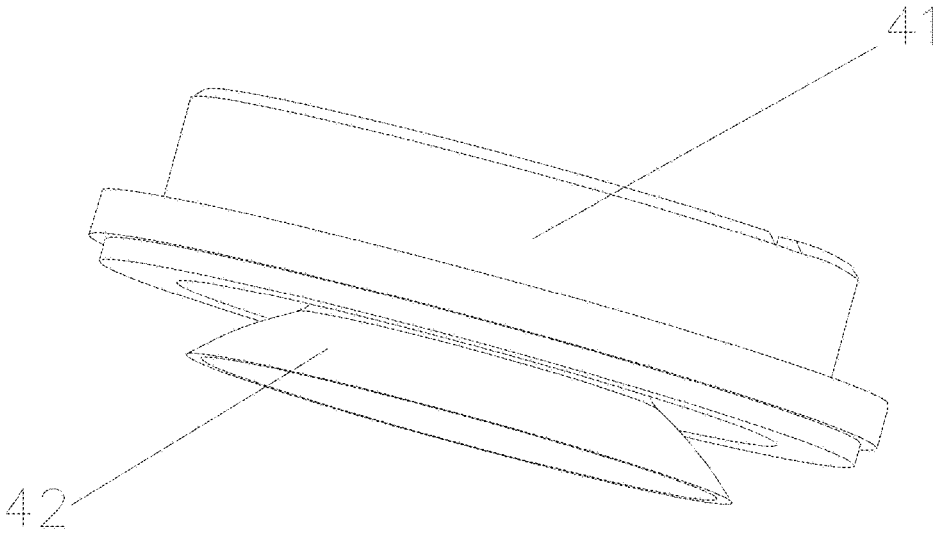
FIG. 22 is the first perspective view of the sucker assembly.

Referring to FIG. 18-FIG. 19, a sucker installation groove is provided at the bottom of the rotary toilet seat 1 for installing the sucker assembly 4. The outer wall of the external mounting ring 411 is clamped with the inner wall of the sucker installation groove, and the top of the external mounting ring 411 is clamped with the groove bottom of the sucker installation groove. The height of the top of the external mounting ring 411 is higher than that of the top of the central fixing sleeve 412, and there is a ventilation gap between the top of the central fixing sleeve 412 and the groove bottom of the sucker installation groove. When the elastic ventilation cut 420 is opened, it communicates with the air guide channel 410 through the ventilation gap.

Figure 13:
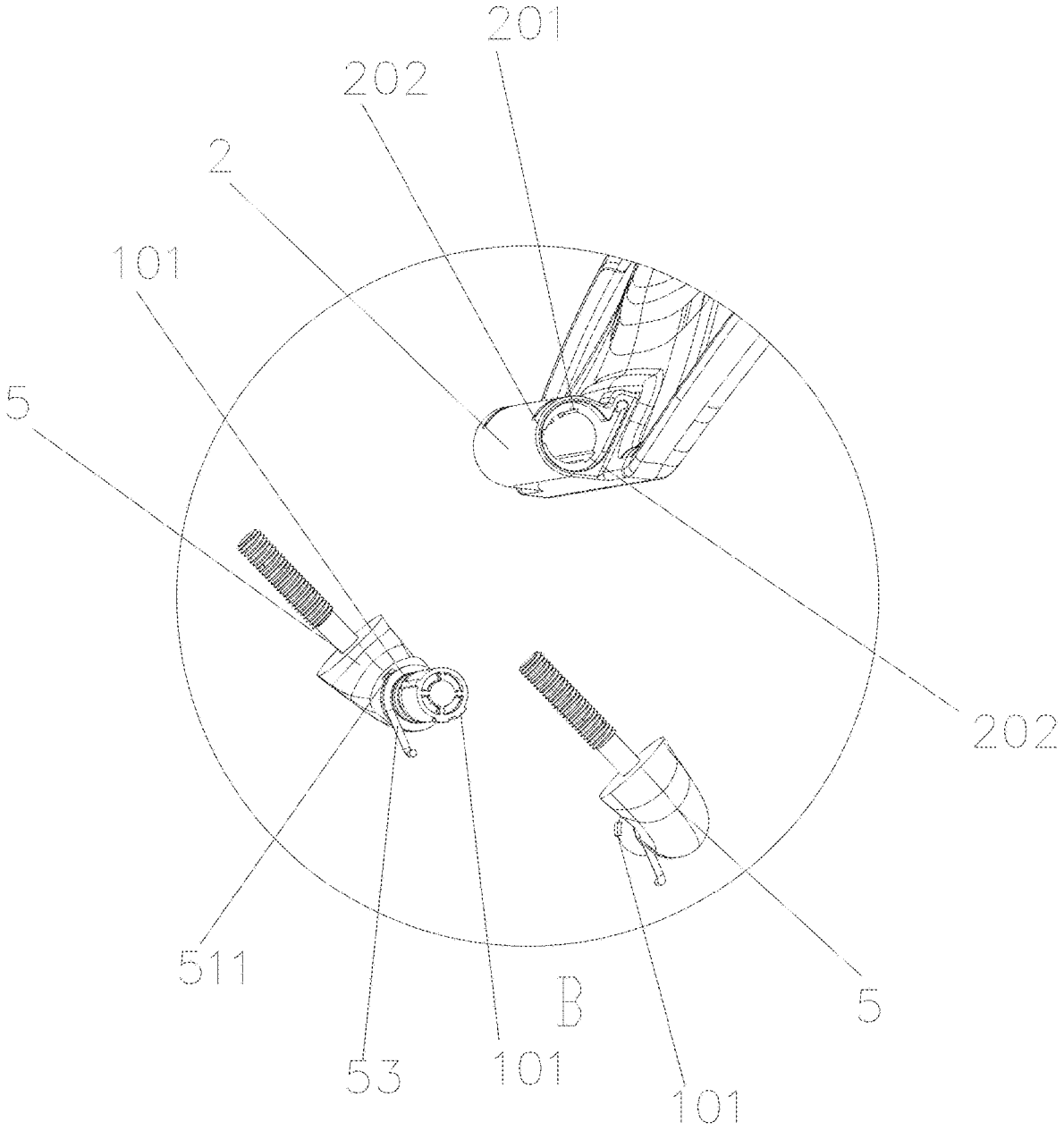
FIG. 13 is an enlarged partial view of part B in FIG. 12.
Figure 14:
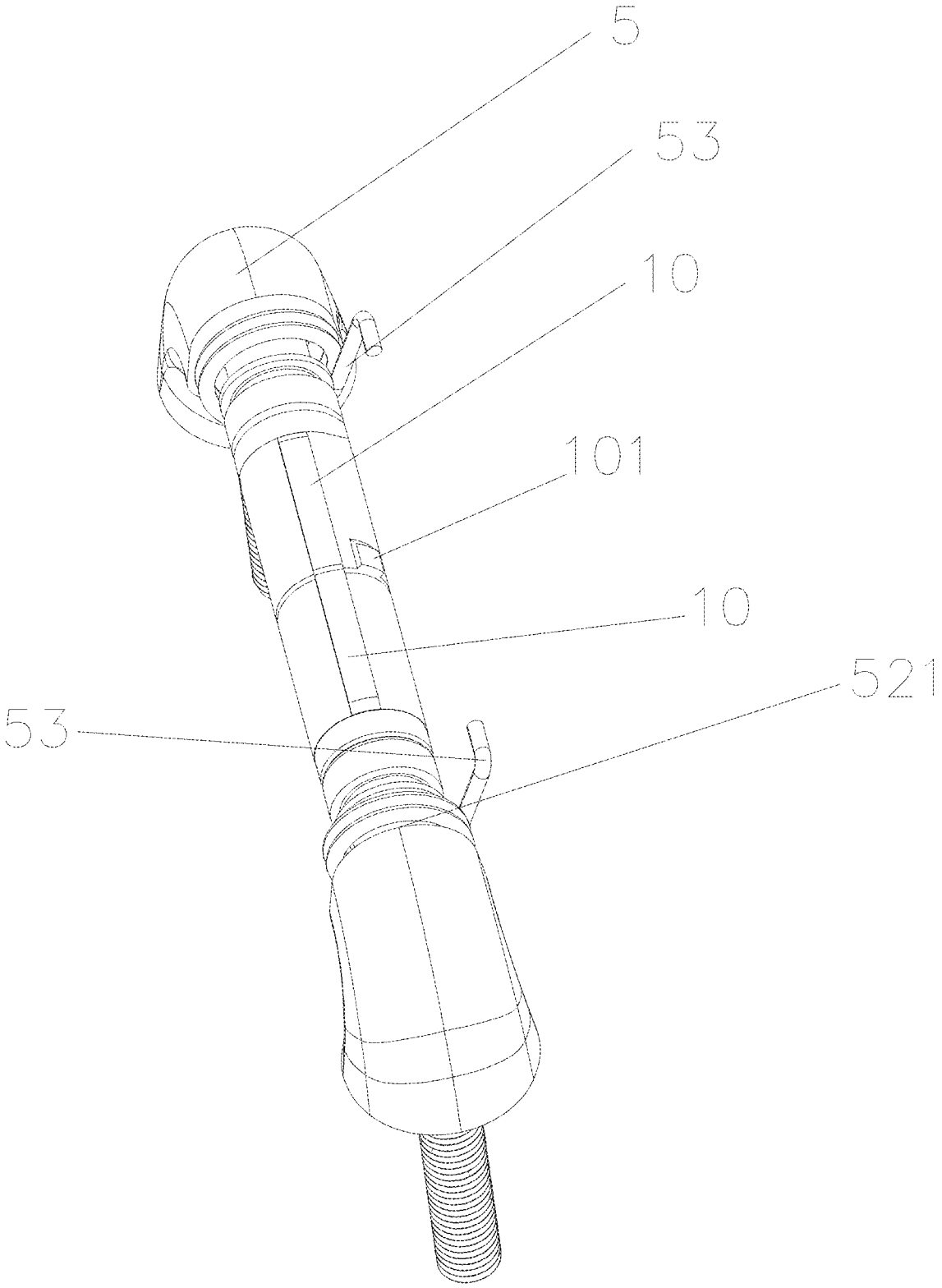
FIG. 14 is the first perspective view shown that two hinge driving assemblies integrated with two hydraulic hinges.
Figure 15:
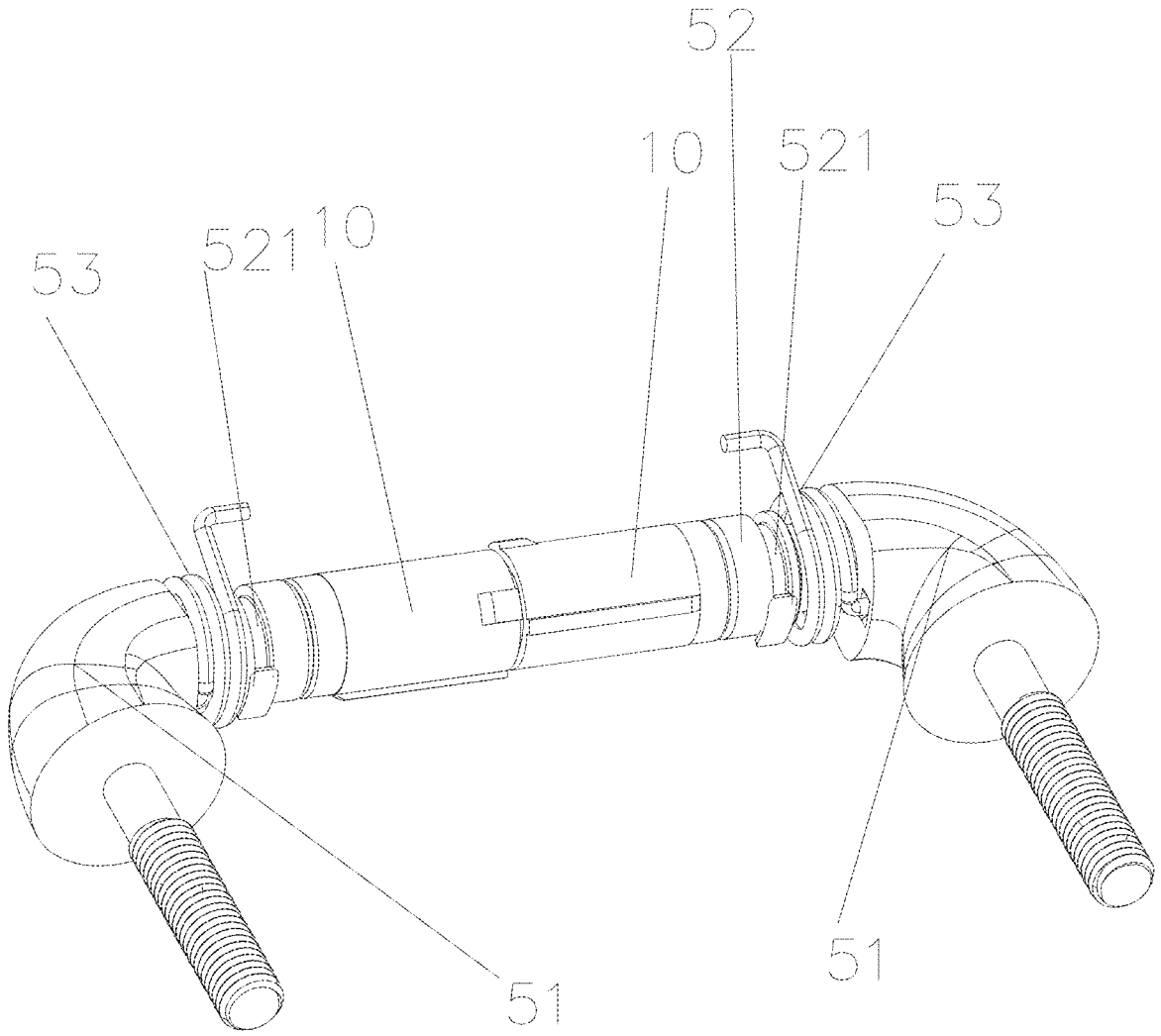
FIG. 15 is the second perspective view shown that the two hinge driving assemblies integrated with the two hydraulic hinges.
Figure 16:
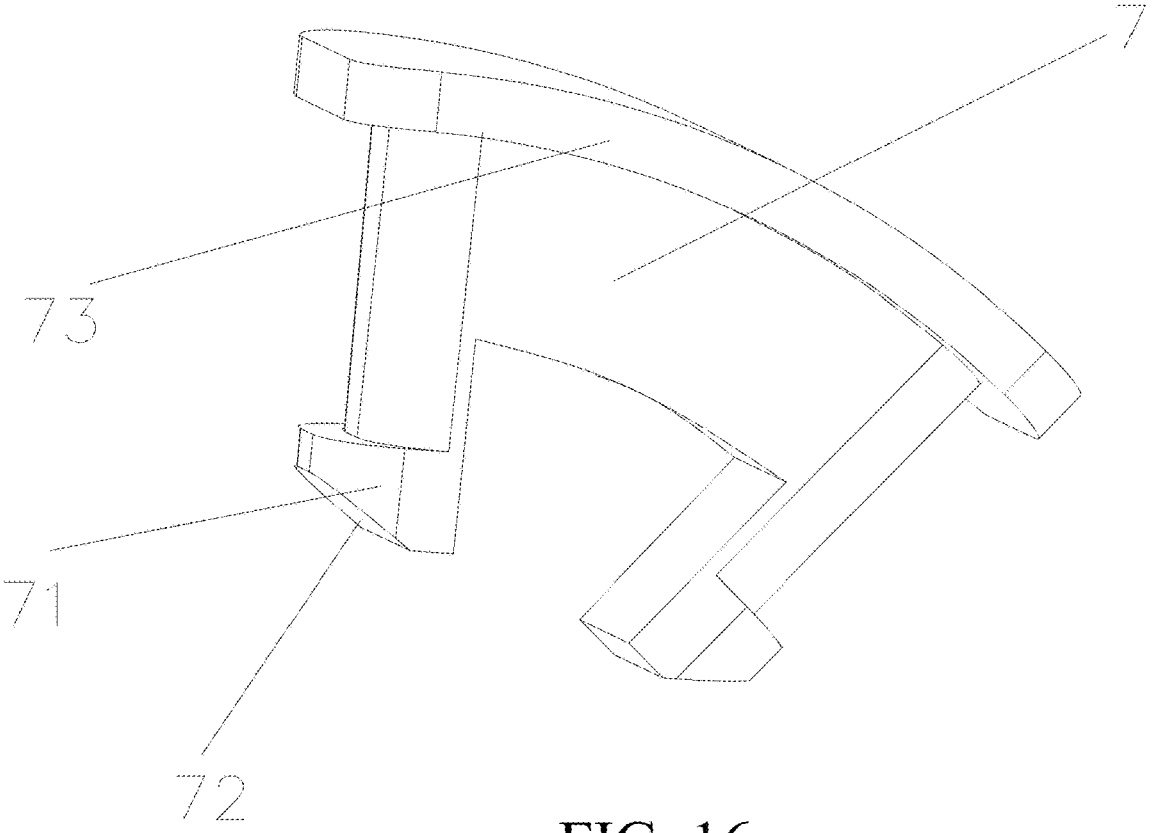
FIG. 16 is the first perspective view of a clamping piece of the present disclosure.
Figure 17:
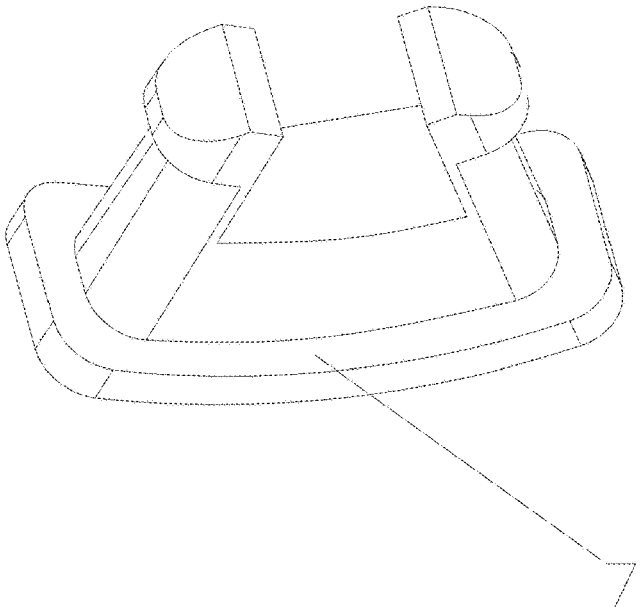
FIG. 17 is the second perspective view of the clamping piece of the present disclosure.

Referring to FIG. 13, a transverse slot 511 is provided on the fixed rotary arm 51, and the fixed end of the driving torsion spring 53 is inserted into the transverse slot to position the driving torsion spring 53 on the fixed rotary arm 51. A driving slot 201 is provided on the inner wall of the rotating shaft sleeve 2, and the driving end of the driving torsion spring 53 is inserted into the driving slot to drive the rotating shaft sleeve 2 to rotate relative to the fixed rotary arm 51 under its own elastic force.

Referring to FIG. 13-FIG. 17, a fixed clamp block 101 is provided on the outer wall of one end of the hydraulic hinge 10. A positioning clamp slot 202 is provided in the rotating shaft sleeve 2 to clamp the fixed clamp block 101. A clamp hole 203 is provided on the outer wall of the rotating shaft sleeve 2. An annular sliding groove 521 is provided on the transverse support shaft 52 at the opposite position of the clamp hole 203. A clamping piece 7 is installed in the clamp hole 203, which can pass through the rotating shaft sleeve 2 and snap onto one side wall of the annular sliding groove 521 and slide along the annular sliding groove 521. The clamping piece 7 is in the form of a sheet, but can also be designed in various shapes such as block, column, etc. There are two elastic hooks 71 at the bottom of the clamping piece 7, and a guide sliding slope 72 at the top of the elastic hook 71. The function of the clamping piece 7 is to connect the fixed rotary arm 51 with the rotating shaft sleeve 2 together. During assembly, the hydraulic hinge 10 is now installed in the rotating shaft sleeve 2 through the engagement of the fixed clamp block 101 and the positioning clamp slot 202. The engagement of the fixed clamp block 101 and the positioning clamp slot 202 is to enable the hydraulic hinge to rotate synchronously with the rotating shaft sleeve 2. Then, the transverse support shaft 52 of the fixed rotary arm 51 is inserted into the rotating shaft sleeve 2, so that the square slot at the end of the transverse support shaft 52 is engaged with the square end of the rotating shaft core of the hydraulic hinge 10. When the transverse support shaft 52 is installed horizontally in place, the clamping piece 7 is inserted into the clamp hole 203, the two elastic hooks 71 are compressed by the wall of the clamp hole 203 and undergo elastic deformation, and the guide sliding slope 72 facilitates the smoother insertion of the clamping piece 7 along the clamp hole 203. When the clamping piece is inserted in place, the elastic hook 71 resets and is stuck on the inner edge of the clamp hole 203, the protruding part of the elastic hook 71 from the clamp hole 203 is just inserted into the annular sliding groove 521 of the transverse support shaft 52, so that the fixed rotary arm is installed on the rotating shaft sleeve 2. In order to achieve a better stabilize installation of the clamping piece 7 into the clamp hole 203, a curved clamp edge 73 with a width greater than the width of the other parts of the clamping piece 7 is provided at the top of the clamping piece 7. A curved clamp platform is provided inside the clamp hole 203 to engage with the curved clamp edge. Therefore, when the clamping piece 7 is installed in the clamp hole 203, the elastic hook 71 and the curved clamp edge 73 are respectively matched with the inner edge of the clamp hole 203 and the curved clamp platform, achieving the two ends of the clamping piece 7 to snap with the clamp hole 203, making the installation of the transverse support shaft 52 and the rotating shaft sleeve 2 more stable and not easy to detach.

Due to the fact that the rotating shaft core of the hydraulic hinge is fixed on the transverse support shafts 52 of the fixed rotary arms 51, when the driving end of the driving torsion spring 53 drives the rotating shaft sleeve 2, the rotating shaft sleeve 2 can drive the hydraulic hinge 10 and the clamping piece 7 to rotate synchronously relative to the toilet base and the fixed rotary arms 51. The clamping piece 7 rotates in a circumferential direction in the annular sliding groove 521. Therefore, by cooperating with the elastic hook 71 of the clamping piece 7 and the annular sliding groove 521, two functions are achieved: one is to connect the transverse support shaft 52 of the fixed rotary arm 51 to the rotating shaft sleeve 2, and the other is to achieve relative rotation between the clamping piece and the transverse support shaft 52.

The working principle of the present disclosure is as follows:

1. When in use, after pressing the rotary toilet seat down to touch the ceramic surface, the bottom "sucker assembly" will adhere to the ceramic surface and be in a fitting state. Compared to the common rotary toilet seats on the market, which are equipped with ordinary rubber nails and ordinary soft rubber nails, the use experience is poor since the stability is insufficient caused by the left and right swinging vibration during sitting. Due to the "sucker assembly" is equipped with sucker soft rubber and anti slip soft rubber, the rotary toilet seat provided by the present disclosure has anti-slip function, which can firmly adhere to the ceramic surface during sitting, making the rotary toilet seat unable to sway left and right, so as to provide a high vibration stability and more advanced use experience.
2. After use or the rotary toilet seat without pressure, the air groove of the bottom "sucker assembly" will slowly intake air for a predetermined time, then the suction force of the sucker decreases or disappears, so that the sucker will be released. Under the torque of the torsion spring in the "hinge assembly", the rotary toilet seat will automatically open upwards by a certain angle.
3. After the rotary toilet seat opens upwards by a certain angle, during the process of continuing upwards, it slowly opens upwards until it is in an upright position under the action of the buffer, so that the product achieves a silent, clean and hygienic effect during use.

The above embodiments are only the preferred embodiments of the present disclosure and do not limit the present disclosure in any form. Any skilled person in the art, without departing from the scope of the technical solution of the present disclosure, who use the technical content disclosed above to make more possible changes, variants, or modifications to the technical solution of the present disclosure, are equivalent embodiments of the present disclosure. Therefore, any equivalent changes made based on the concept of the present disclosure without departing from the technical solution of the present disclosure should be covered within the scope of the present disclosure.

What is claimed is:

1. A toilet seat with delay suction release and automatically stand upright, comprising a rotary toilet seat rotatably connected to a toilet base, and a rotating shaft sleeve provided with a hydraulic hinge inside fixed at an end of the rotary toilet seat, wherein a delay suction release and automatically stand upright control device allowing the rotary toilet seat to automatically stand up relative to the toilet base is provided on the rotary toilet seat; the delay suction release and automatically stand upright control device comprises a sucker assembly for delay suction release set on the rotary toilet seat and a hinge driving assembly configured to drive the rotary toilet seat to rotate and raise up;

the sucker assembly comprises a hard mounting frame fixed at a bottom of a side of the rotary toilet seat and a sucker body detachably fixed on the hard mounting frame, wherein the sucker body cooperates with a contact surface of the toilet base to form a sealed space; the sucker body comprises a sucker connection part connected to an inner wall of the hard mounting frame and a suction part connected to a lower end of the sucker connection part; a deformable top plate is provided at a top of the sucker connection part, and an elastic ventilation cut is provided on the deformable top plate to communicate an interior of the sucker body with an air guide channel;

the hinge driving assembly comprises a fixed rotary arm fixed on each of both sides of the toilet base, a transverse support shaft provided on the fixed rotary arm, and a driving torsion spring provided on the transverse support shaft, wherein the transverse support shaft is fixedly connected to a rotating shaft core of the hydraulic hinge, a fixed end of the driving torsion spring is fixed to the fixed rotary arm, and a driving end of the driving torsion spring is fixed to an inner wall of the rotating shaft sleeve; and when the rotary toilet seat is not under pressure, an external atmosphere slowly enters the suction part through the air guide channel of the sucker assembly from the elastic ventilation cut, causing a suction force between the suction part and the toilet base to gradually decrease, until a rotational elastic force of the driving torsion spring of the hinge driving assembly is greater than the suction force of the suction part, the driving torsion spring drives the rotary toilet seat to automatically open upwards relative to the toilet base.

2. The toilet seat with delay suction release and automatically stand upright according to claim 1, wherein an external mounting ring and a central fixing sleeve are provided on the hard mounting frame, and the external mounting ring and the central fixing sleeve are formed in integration; the air guide channel is provided between the external mounting ring and the central fixing sleeve; the sucker body is installed inside the central fixing sleeve, and the sucker connection part of the sucker body is clamped with an inner wall of the central fixing sleeve in a snap-fit.

3. The toilet seat with delay suction release and automatically stand upright according to claim 1, wherein the sucker assembly further comprises a deformable tube for supporting the sucker connection part, and the deformable top plate is set at a top of the deformable tube; an annular clamping groove is provided on an outer wall of the deformable tube, and a clamping protrusion is provided on an inner wall of the sucker connection part and is connected with the annular clamping groove in a snap-fit.

4. The toilet seat with delay suction release and automatically stand upright according to claim 2, wherein a quick installation structure is provided between the sucker body and the central fixing sleeve for quickly installing the sucker body on the hard mounting frame, and the quick installation structure comprises a quick installation convex ring provided on an outer wall of the sucker connection part and a quick installation hook provided on the central fixing sleeve and engaged with the quick installation convex ring in the snap-fit.

5. The toilet seat with delay suction release and automatically stand upright according to claim 4, wherein the quick installation hook or the central fixing sleeve is provided with a strip-shaped through-hole/groove, wherein the strip-shaped through-hole/groove facilitates a deformation of the quick installation hook.

6. The toilet seat with delay suction release and automatically stand upright according to claim 1, wherein a side, located on the sucker body, of the hard mounting frame is provided with a protective pad, and the protective pad is configured to abut with the contact surface when the sucker body is in contact with the contact surface.

7. The toilet seat with delay suction release and automatically stand upright according to claim 2, wherein a plurality of spaced-apart connecting ribs are connected between the external mounting ring and the central fixing sleeve, and a plurality of air guide channels arranged at intervals are formed between the plurality of spaced-apart connecting ribs and are connected to the external atmosphere.

8. The toilet seat with delay suction release and automatically stand upright according to claim 2, wherein a sucker installation groove for installing the sucker assembly is provided at a bottom of the rotary toilet seat, an outer wall of the external mounting ring is clamped with an inner wall of the sucker installation groove, a top of the external mounting ring is clamped at a bottom of the sucker installation groove, a height of the top of the external mounting ring is higher than a height of a top of the central fixing sleeve, and a ventilation gap is formed between the top of the central fixing sleeve and the bottom of the sucker installation groove; and when the elastic ventilation cut is opened, the elastic ventilation cut communicates with the air guide channel through the ventilation gap.

9. The toilet seat with delay suction release and automatically stand upright according to claim 1, wherein a transverse slot is provided on the fixed rotary arm, the fixed end of the driving torsion spring is inserted into the transverse slot to position the driving torsion spring on the fixed rotary arm, a driving slot is provided on the inner wall of the rotating shaft sleeve, and the driving end of the driving torsion spring is inserted into the driving slot to drive the rotating shaft sleeve to rotate relative to the fixed rotary arm under an elastic force of the driving torsion spring.

10. The toilet seat with delay suction release and automatically stand upright according to claim 1, wherein a fixed clamp block is provided on an outer wall of an end of the hydraulic hinge, a positioning clamp slot for clamping the fixed clamp block is provided in the rotating shaft sleeve, a clamp hole is provided on an outer wall of the rotating shaft sleeve, an annular sliding groove is provided on the transverse support shaft and opposite to the clamp hole, a clamping piece is installed in the clamp hole, and the clamping piece is configured to pass through the rotating shaft sleeve to snap onto a side wall of the annular sliding groove and slide along the annular sliding groove.

* * * * *